US006672406B2

(12) United States Patent
Beuershausen

(10) Patent No.: US 6,672,406 B2
(45) Date of Patent: Jan. 6, 2004

(54) MULTI-AGGRESSIVENESS CUTTTING FACE ON PDC CUTTERS AND METHOD OF DRILLING SUBTERRANEAN FORMATIONS

(75) Inventor: Christopher C. Beuershausen, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 2 days.

(21) Appl. No.: 09/748,771

(22) Filed: Dec. 21, 2000

(65) Prior Publication Data

US 2001/0040053 A1 Nov. 15, 2001

Related U.S. Application Data

(63) Continuation-in-part of application No. 08/925,525, filed on Sep. 8, 1997, now Pat. No. 6,230,828.

(51) Int. Cl.[7] ..... E21B 10/46
(52) U.S. Cl. ..... 175/57; 175/430; 175/431
(58) Field of Search ..... 175/430, 431, 175/426, 432, 57

(56) References Cited

U.S. PATENT DOCUMENTS

| | | | |
|---|---|---|---|
| 4,109,737 | A | 8/1978 | Bovenkerk |
| 4,342,368 | A | 8/1982 | Denman |
| RE32,036 | E | 11/1985 | Dennis |

(List continued on next page.)

FOREIGN PATENT DOCUMENTS

| | | |
|---|---|---|
| GB | 2 318 140 A | 4/1998 |
| GB | 2 323 398 A | 9/1998 |
| WO | WO 97/30263 | 8/1997 |

OTHER PUBLICATIONS

Search Report under Section 17 dated Jan. 7, 1999.

Search Report United Kingdom Application No. GB 0130118.3 dated Apr. 12, 2002.

*Primary Examiner*—Heather Shackelford
*Assistant Examiner*—Sunil Singh
(74) *Attorney, Agent, or Firm*—TraskBritt

(57) ABSTRACT

Methods of drilling subterranean formations with rotary drag bits equipped with cutting elements including superabrasive, multi-aggressive cutting faces or profiles which are especially suitable for drilling formations of varying hardness and for directional drilling through formations of varying hardness are disclosed. Methods including providing and using rotary drill bits incorporating cutting elements having appropriately aggressive and appropriately positioned cutting surfaces so as to enable the cutting elements to engage the particular formation being drilled at an appropriate depth-of-cut at a given weight-on-bit to maximize rate of penetration without generating excessive, unwanted torque on bit are disclosed. The configuration, surface area, and effective backrake angle of each provided cutting surface, as well as individual cutter backrake angles, may be customized and varied to provide a cutting element having a cutting face aggressiveness profile that varies both longitudinally and radially along the cutting face of the cutting element.

43 Claims, 14 Drawing Sheets

U.S. PATENT DOCUMENTS 4,558,753 A 12/1985 Barr
4,570,726 A 2/1986 Hall
4,592,433 A 6/1986 Dennis
4,593,777 A 6/1986 Barr
4,607,711 A 8/1986 Zijsling
4,660,659 A 4/1987 Short, Jr. et al.
4,673,044 A 6/1987 Bigelow et al.
4,679,639 A 7/1987 Barr et al.
4,792,001 A 12/1988 Zijsling
4,808,044 A 2/1989 Tsujimura et al.
4,926,950 A 5/1990 Zijsling
4,932,484 A 6/1990 Warren et al.
4,987,800 A 1/1991 Gasan et al.
5,016,718 A 5/1991 Tandberg
5,025,874 A 6/1991 Barr et al.
5,078,219 A 1/1992 Morrell et al.
5,101,691 A 4/1992 Barr
5,120,327 A 6/1992 Dennis
5,351,772 A 10/1994 Smith
5,377,773 A 1/1995 Tibbitts
5,437,343 A 8/1995 Cooley et al.
5,443,565 A 8/1995 Strange, Jr.
5,460,233 A 10/1995 Meany et al.
5,467,836 A 11/1995 Grimes et al.
5,549,171 A 8/1996 Mensa-Wilmot et al.
5,605,198 A 2/1997 Tibbitts et al.
5,655,612 A 8/1997 Grimes et al.
5,706,906 A 1/1998 Jurewicz et al.
5,722,499 A 3/1998 Nguyen et al.
5,743,346 A 4/1998 Flood et al.
5,924,501 A 7/1999 Tibbitts
5,937,958 A * 8/1999 Mensa-Wilmot et al. ... 175/431
5,960,896 A 10/1999 Barr et al.
6,000,483 A 12/1999 Jurewicz et al.
6,003,623 A 12/1999 Miess
6,065,554 A * 5/2000 Taylor et al. ..... 175/430

* cited by examiner

MULTI-AGGRESSIVENESS CUTTTING FACE ON PDC CUTTERS AND METHOD OF DRILLING SUBTERRANEAN FORMATIONS

RELATED APPLICATION

This application is a continuation-in-part of U.S. patent application filed Sep. 8, 1997, having Ser. No. 08/925,525 and entitled Rotary Drill Bits for Directional Drilling Exhibiting Variable Weight-On-Bit Dependent Cutting Characteristics, now issued U.S. Pat. No. 6,230,828 B1.

BACKGROUND OF THE INVENTION

1. Field of the Invention

The present invention relates generally to methods of drilling subterranean formations with fixed cutter-type drill bits. More specifically, the invention relates to methods of drilling, including directional drilling, with fixed cutter, or so-called " drag," bits wherein the cutting face of the cutters of the bits are tailored to have different cutting aggressiveness to enhance response of the bit to sudden variations in formation hardness, to improve stability and control of the toolface of the bit, to accommodate sudden variations on weight on bit (WOB), and to optimize the rate of penetration (ROP) of the bit through the formation regardless of the relative hardness of the formation being drilled.

2. Background of the Invention

In state-of-the-art directional drilling of subterranean formations, also sometimes termed steerable or navigational drilling, a single bit disposed on a drill string, usually connected to the drive shaft of a downhole motor of the positive-displacement (Moineau) type, is employed to drill both linear (straight) and nonlinear (curved) borehole segments without tripping, or removing, the drill string from the borehole to change out bits specifically designed to bore either linear or nonlinear boreholes. Use of a deflection device such as a bent housing, bent sub, eccentric stabilizer, or combinations of the foregoing in a bottomhole assembly (BHA) including a downhole motor permit a fixed rotational orientation of the bit axis at an angle to the drill string axis for nonlinear drilling when the bit is rotated solely by the drive shaft of the downhole motor. When the drill string is rotated by a top-side motor in combination with rotation of the downhole motor shaft, the superimposed, simultaneous rotational motions cause the bit to drill substantially linearly or, in other words, causes the bit to drill a generally straight borehole. Other directional methodologies employing non-rotating BHAs using lateral thrust pads or other members immediately above the bit also permit directional drilling using drill string rotation alone.

In either case, for directional drilling of nonlinear, or curved, borehole segments, the face aggressiveness (aggressiveness of the cutters disposed on the bit face) is a significant feature, since it is largely determinative of how a given bit responds to sudden variations in bit load or formation hardness. Unlike roller cone bits, rotary drag bits employing fixed superabrasive cutters (usually comprising polycrystalline diamond compacts, or " PDCs") are very sensitive to load, which sensitivity is reflected in a much steeper rate of penetration (ROP) versus weight on bit (WOB) and torque on bit (TOB) versus WOB curves, as illustrated in FIGS. 1 and 2 of the drawings. Such high WOB sensitivity causes problems in directional drilling, wherein the borehole geometry is irregular and resulting "sticktion" of the BHA when drilling a nonlinear path renders a smooth, gradual transfer of weight to the bit extremely difficult. These conditions frequently cause downhole motor stalling and result in the loss of control of tool face orientation of the bit, and/or cause the tool face of the bit to swing to a different orientation. When control of tool face orientation is lost, borehole quality often declines dramatically. In order to establish a new tool face reference point before drilling is recommenced, the driller must stop drilling ahead, or making hole, and pull the bit off the bottom of the borehole. Such a procedure is time consuming, expensive, results in loss of productive rig time and causes a reduction in the average ROP of the borehole. Conventional methods to reduce rotary drag bit face aggressiveness include greater cutter densities, higher (negative) cutter backrakes and the addition of wear knots to the bit face.

Of the bits referenced in FIGS. 1 and 2 of the drawings, RC comprises a conventional roller cone bit for reference purposes, while FC1 is a conventional polycrystalline diamond compact (PDC) cutter-equipped rotary drag bit having cutters backraked at 20°, and FIG. 2 is the directional version of the same bit with 30° backraked cutters. As can be seen from FIG. 2, the TOB at a given WOB for FC2, which corresponds to its face aggressiveness, can be as much as 30% less than as for FC1. Therefore, FC2 is less affected by the sudden load variations inherent in directional drilling. However, referencing FIG. 1, it can also be seen that the less aggressive FC2 bit exhibits a markedly reduced ROP for a given WOB, in comparison to FIG. 2.

Thus, it may be desirable for a bit to demonstrate the less aggressive characteristics of a conventional directional bit such as FC2 for nonlinear drilling without sacrificing ROP to the same degree when WOB is increased to drill a linear borehole segment.

For some time, it has been known that forming a noticeable, annular chamfer on the cutting edge of the diamond table of a PDC cutter has enhanced durability of the diamond table, reducing its tendency to spall and fracture during the initial stages of a drilling operation before a wear flat has formed on the side of the diamond table and supporting substrate contacting the formation being drilled.

U.S. Patent No. Re 32,036 to Dennis discloses such a chamfered cutting edge, disc-shaped PDC cutter comprising a polycrystalline diamond table formed under high-pressure and high-temperature conditions onto a supporting substrate of tungsten carbide. For conventional PDC cutters, a typical chamfer size and angle would be 0.010 of an inch (measured radially and looking at and perpendicular to the cutting face) oriented at approximately a 45° angle with respect to the longitudinal cutter axis, thus providing a larger radial width as measured on the chamfer surface itself.

Multichamfered PDC cutters are also known in the art. For example a multichambered cutter is taught by Cooley et al., U.S. Pat. No. 5,437,343, assigned to the assignee of the present invention. In particular the Cooley et al. patent discloses a PDC cutter having a diamond table having two concentric chamfers. A radially outermost chamfer D1 is taught as being disposed at an angle $\alpha$ of 20° and an innermost chamfer D2 is taught as being disposed at an angle $\beta$ of 45° as measured from the periphery, or radially outermost extent, of the cutting element. An alternative cutting element having a diamond table in which three concentric chamfers are provided thereon is also taught by the Cooley et al. patent. The specification of the Cooley et al. patent provides discussion directed toward explaining how cutting elements provided with such multiple chamfer cutting edge geometry provides excellent fracture resistance combined with cutting efficiency generally comparable to standard unchamfered cutting elements.

U.S. Pat. No. 5,443,565 to Strange Jr. discloses a cutting element having a cutting face incorporating a dual bevel configuration. More specifically in column 3, lines 35–53, and as illustrated in FIG. 5, Strange Jr. discloses a cutting element 9 having a cutting face 10 provided with a first bevel 12 and a second bevel 14. Bevel 12 is described as extending at a first bevel angle 12 with respect to the longitudinal axis of cutting element 9. Likewise, bevel 14 is described as extending at a second bevel angle 15 also measured with respect to the longitudinal axis of cutter 9. The specification, in the same above-referenced section, states that the subject cutting element had increased drilling efficiency and increased cutting element and bit life because the bevels served to minimize splitting, chipping, and cracking of the cutting element during the drilling process, which in turn resulted in decreased drilling time and expenses.

U.S. Pat. No. 5,467,836 to Grimes et al. is directed toward gage cutting inserts and depicts in FIG. 2 thereof an insert 31 having a cutting end 35 formed of a superabrasive material and which is provided with a wear-resistant face 37 thereon. Insert 31 is further described as having two cutting edges 41*a* and 41*b* with cutting edge 41*b* formed by the intersection of a circumferential bevel 43 and face 37 on cutting end 35. The other cutting edge 41*a* is formed by the intersection of a flat or planar bevel 45, face 37, and circumferential bevel 43, defining a chord across the circumference of the generally cylindrical gage insert 31. Because insert 31 is intended to be installed at the gage of a drill bit, wear-resistant face 37 is taught to face radially outwardly from the bit to provide a nonaggressive wear surface as well as to thereby allow planar bevel 45 to engage the formation as the drill bit is rotated.

U.S. Pat. No. 4,109,737 to Bovenkerk is directed toward cutting elements having a thin layer of polycrystalline diamond bonded to a free end of an elongated pin. One particular cutting element variation shown in FIG. 4G of Bovenkerk comprises a generally hemispherical diamond layer having a plurality of flats formed on the outer surface thereof According to Bovenkerk, the flats tend to provide an improved cutting action due to the plurality of edges which is formed on the outer surface by the contiguous sides of the flats.

Rounded, rather than chamfered, cutting edges are also known, as disclosed in U.S. Pat. No. 5,016,718 to Tandberg.

For some period of time, the diamond tables of PDC cutters were limited in depth or thickness to about 0.030 of an inch or less, due to the difficulty in fabricating thicker tables of adequate quality. However, recent process improvements have provided much thicker diamond tables, in excess of 0.070 of an inch, including diamond tables approaching and exceeding 0.150 of an inch. U.S. Pat. No. 5,706,906 to Jurewicz et al., assigned to the assignee of the present invention and hereby incorporated herein by this reference, discloses and claims several configurations of a PDC cutter employing a relatively thick diamond table. Such cutters include a cutting face bearing a large chamfer or "rake land" thereon adjacent the cutting edge, which rake land may exceed 0.050 of an inch in width, measured radially and across the surface of the rake land itself. U.S. Pat. No. 5,924,501 to Tibbitts, assigned to the assignee of the present invention, discloses and claims several configurations of a superabrasive cutter having a superabrasive volume thickness of at least about 0.150 of an inch. Other cutters employing a relatively large chamfer without such a great depth of diamond table are also known.

Recent laboratory testing as well as field tests have conclusively demonstrated that one significant parameter affecting PDC cutter durability is the cutting edge geometry. Specifically, larger leading chamfers (the first chamfer on a cutter to encounter the formation when the bit is rotated in the normal direction) provide more durable cutters. The robust character of the above-referenced "rake land" cutters corroborates these findings. However, it was also noticed that cutters exhibiting large chamfers would also slow the overall performance of a bit so equipped in terms of ROP. This characteristic of large chamfer cutters was perceived as a detriment.

It has also recently been recognized that formation hardness has a profound affect on the performance of drill bits as measured by the ROP through the particular formation being drilled by a given drill bit. Furthermore, cutters installed in the face of a drill bit so as to have their respective cutting faces oriented at a given rake angle will likely produce ROPs that vary as a function of formation hardness. That is, if the cutters of a given bit are positioned so that their respective cutting faces are oriented with respect to a line perpendicular to the formation, as taken in the direction of intended bit rotation, so as to have a relatively large back (negative) rake angle, such cutters would be regarded as having relatively nonaggressive cutting action with respect to engaging and removing formation material at a given WOB. Contrastingly, cutters having their respective cutting faces oriented so as to have a relatively small back (negative) rake angle, a zero rake angle, or a positive rake angle would be regarded as having relatively aggressive cutting action at a given WOB with a cutting face having a positive rake angle being considered most aggressive and a cutting face having a small back rake angle being considered aggressive but less aggressive than a cutting face having a zero back rake angle and even less aggressive than a cutting face having a positive back rake angle.

It has further been observed that when drilling relatively hard formations, such as limestones, sandstones, and other consolidated formations, bits having cutters which provide relatively nonaggressive cutting action decrease the amount of unwanted reactive torque and provide improved tool face control, especially when engaged in directional drilling. Furthermore, if the particular formation being drilled is relatively soft, such as unconsolidated sand and other unconsolidated formations, such relatively nonaggressive cutters, due to the large depth-of-cut (DOC) afforded by drilling in soft formations, result in a desirable, relatively high ROP at a given WOB. However, such relatively nonaggressive cutters when encountering a relative hard formation, which it is very common to repeatedly encounter both soft and hard formations when drilling a single borehole, will experience a decreased ROP with the ROP generally becoming low in proportion to the hardness of the formation. That is, when using bits having nonaggressive cutters, the ROP generally tends to decrease as the formation becomes harder and increase as the formation becomes softer because the relatively nonaggressive cutting faces simply can not "bite" into the formation at a substantial DOC to sufficiently engage and efficiently remove hard formation material at a practical ROP. That is, drilling through relative hard formations with nonaggressive cutting faces simply takes too much time.

Contrastingly, cutters which provide relatively aggressive cutting action excel at engaging and efficiently removing hard formation material as the cutters generally tend to aggressively engage, or "bite," into hard formation material. Thus, when using bits having aggressive cutters, the bit will often deliver a favorably high ROP, taking into consideration the hardness of the formation, and generally the harder the formation, the more desirable it is to have yet more aggressive cutters to better contend with the harder formations and to achieve a practical, feasible ROP therethrough.

It would be very helpful to the oil and gas industry, in particular, when using drag bits to drill boreholes through formations of varying degrees of hardness if drillers did not have to rely upon one drill bit designed specifically for hard formations, such as, but not limited to, consolidated sandstones and limestones and to rely upon another drill bit designed specifically for soft formations, such as, but not limited to, unconsolidated sands. That is, drillers frequently have to remove from the borehole, or trip out, a drill bit having cutters that excel at providing a high ROP in hard formations upon encountering a soft formation, or a soft "stringer," in order to exchange the hard-formation drill bit with a soft formation drill bit, or vice versa, when encountering a hard formation, or hard "stringer," when drilling primarily in soft formations.

Furthermore, it would be very helpful to the industry when conducting subterranean drilling operations and especially when conducting directional drilling operations, if methods were available for drilling which would allow a single drill bit be used in both relatively hard and relatively soft formations. Such a drill bit would thereby prevent an unwanted and expensive interruption of the drilling process to exchange formation-specific drill bits when drilling a borehole through both soft and hard formations. Such helpful drilling methods, if available, would result in providing a high, or at least an acceptable, ROP for the borehole being drilled through a variety of formations of varying hardness.

It would further be helpful to the industry to be provided with methods of drilling subterranean formations in which the cutting elements provided on a drag-type drill bit, for example, are able to efficiently engage the formation at an appropriate DOC suitable for the relative hardness of the particular formation being drilled at a given WOB, even if the WOB is in excess of what would be considered optimal for the ROP at that point in time. For example, if a drill bit provided with cutters having relatively aggressive cutting faces is drilling a relatively hard formation at a selected WOB suitable for the ROP of the bit through the hard formation and suddenly "breaks through" the relatively hard formation into a relatively soft formation, the aggressive cutters will likely overengage the soft formation. That is, the aggressive cutters will engage the newly encountered soft formation at a large DOC as a result of both the aggressive nature of the cutters and the still-present high WOB that was initially applied to the bit in order to drill through the hard formation at a suitable ROP but which is now too high for the bit to optimally engage the softer formation. Thus, the drill bit will become bogged down in the soft formation and will generate a TOB which, in extreme cases, will rotationally stall the bit and/or damage the cutters, the bit, or the drill string. Should a bit stall upon such a breakthrough occurring the driller must back off, or retract, the bit which was working so well in the hard formation but which has now stalled in the soft formation so that the drill bit may be set into rotational motion again and slowly eased forward to recontact and engage the bottom of the borehole to continue drilling. Therefore, if the drilling industry had methods of drilling wherein a bit could engage both hard and soft formations without generating an excessive amount of TOB while transitioning between formations of differing hardness, drilling efficiency would be increased and costs associated with drilling a wellbore would be favorably decreased.

Moreover, the industry would further benefit from methods of drilling subterranean formations in which the cutting elements provided on a drag bit are able to efficiently engage the formation so as to remove formation material at an optimum ROP yet not generate an excessive amount of unwanted TOB due to the cutting elements being too aggressive for the relative hardness of the particular formation being drilled.

BRIEF SUMMARY OF THE INVENTION

The inventor herein has recognized that providing a drill bit with cutting elements having a cutting face incorporating discrete cutting surfaces of respective size and slopes to effectuate respective degrees of aggressiveness particularly suitable for use in methods of drilling through formations ranging from very soft to very hard without having to trip out of the borehole to change from a first bit designed to drill through a formation of a particular hardness to a second bit designed to drill through a formation of another particular hardness would be very beneficial. Furthermore, the disclosed method of drilling through formations of varying hardness provides enhanced cutting capability and tool face control for nonlinear drilling, as well as providing greater ROP when drilling linear borehole segments than when drilling with conventional directional or steerable bits having highly backraked cutters.

The present invention comprises a method of drilling with a rotary drag bit preferably equipped with PDC cutters wherein the respective cutting faces of at least some of the cutters include at least one radially outermost relatively aggressive cutting surface, at least one relatively less aggressive, sloped cutting surface, and at least one more centermost relatively aggressive cutting surface with each of the cutting surfaces being selectively configured, sized, and positioned such that at a given WOB, or within a given range of WOB, the extent of the DOC of each cutter is modulated in proportion to the hardness of the formation being drilled so as to maximize ROP, maximize toolface control, and minimize unwanted TOB. Thus, the present invention is particularly well-suited for drilling through adjacent formations having widely varying hardnesses and when conducting drilling operations in which the WOB varies widely and suddenly, for example, when conducting directional drilling.

The present method of drilling employing a drill bit incorporating such multi-aggressive cutters noticeably changes the ROP and TOB versus WOB characteristics of the bit by the way the DOC is varied, or modulated, in proportion to the relative hardness of the formation being drilled. In a preferred embodiment of the present invention this is achieved by the formation being engaged by at least one cutting surface having a preselected aggressiveness particularly suitable to provide an appropriate DOC at a given WOB. That is, when drilling through a relatively hard formation with embodiments of the present invention having a radially outermost positioned, aggressive primary cutting surface at or proximate the periphery of the cutter, the cutting face will aggressively engage the hard formation, by virtue of such radially outermost aggressive cutting surface having a relatively aggressive back rake angle with respect to the intended direction of bit rotation when installed in the drill bit and by virtue of the radially outermost primary cutting surface having a relatively small surface area in which to distribute the forces imposed on the bit, i.e., the WOB. Upon drilling through the relatively hard formation and encountering, for example, a formation, or stringer, of relatively softer formation, the intermediately positioned, relatively less aggressive, sloped cutting surface will become the primary cutting surface as the extent of the present DOC will have increased so that the intermediate, sloped cutting surface will engage the formation at a lesser aggressivity, in combination with the relatively more aggressive radially outermost cutting surface so as to prevent an excessive amount of TOB from being generated. Because DOC is, in effect, being modulated as a function of formation hardness, ROP is maximized without resulting in the TOB rising to a troublesome magnitude. Upon encountering a yet softer formation, the method of the present invention further calls into play the centermost, relatively more aggressive cutting surface to engage the formation at a more extensive DOC. That is, the cutting face, when encountering a relatively soft formation, will maximize the extent of DOC by not only engaging the formation with the relatively more aggressive radially outermost cutting surface and the relatively less aggressive intermediately positioned sloped cutting surface, but also with the relatively more aggressive radially centermost most cutting area so as to maximize DOC, thereby maximizing ROP and DOC while minimizing or at least limiting the TOB.

In accordance with the present invention, the relative aggressiveness of each cutting surface included on the cutting face of each cutter is selectively configured, sized, and angled, either by way of being angled with respect to the sidewall of the cutter for example, or by installing the cutter in the drill bit so as to selectively influence the backrake angle of each cutting element as installed in a drill bit used with the present method of drilling.

Optionally, at least one chamfer can be provided on or about the periphery of the radially outermost cutting surface to enhance cutter table life expectancy and/or to influence the degree of aggressivity of the radially outermost cutting surface and hence influence the overall aggressivity profile of the cutting face of a multi-aggressive cutter employed in connection with the present method of drilling.

In accordance with the present invention of drilling a borehole, a cutting element having a cutting face provided with highly aggressive cutting surfaces, or shoulders, positioned circumferentially, or radially, adjacent selected sloped cutting surfaces may be used. Alternatively, aggressive cutting faces may be positioned radially and longitudinally intermediate of selected sloped cutting surfaces of a cutting element used in drilling a borehole in accordance with the present invention. Such highly aggressive, intermediately positioned cutting surfaces, or shoulders, are preferably oriented generally perpendicular to the longitudinal axis of the cutting element, and hence will also generally, but not necessarily, be perpendicular to the peripheral sidewalls of the cutting element. Alternatively, such intermediately positioned cutting surfaces, or shoulders, may be substantially angled with respect to the longitudinal axis of the cutting element so as not to be perpendicular, yet still relatively aggressive. That is, when the cutting element is installed in a drill bit at a selected cutting element, or cutter, backrake angle, generally measured with respect to the longitudinal axis of the cutting element, the shoulder will preferably be angled so as to be highly aggressive with respect to a line generally perpendicular to the formation, as taken in the direction of intended bit rotation. Such highly aggressive shoulders serve to enhance ROP at a given WOB when drilling through formations that are of relatively intermediate hardness i.e., formations which are considered to be neither extremely hard nor extremely soft.

DETAILED DESCRIPTION OF THE INVENTION

As used in the practice of the present invention, and with reference to the size of the chamfers employed in various regions of the exterior of the bit, it should be recognized that the terms "large" and "small" chamfers are relative, not absolute, and that different formations may dictate what constitutes a relatively large or small chamfer on a given bit. The following discussion of "small" and "large" chamfers is, therefore, merely exemplary and not limiting in order to provide an enabling disclosure and the best mode of practicing the invention as currently understood by the inventors.

Figure 3A:
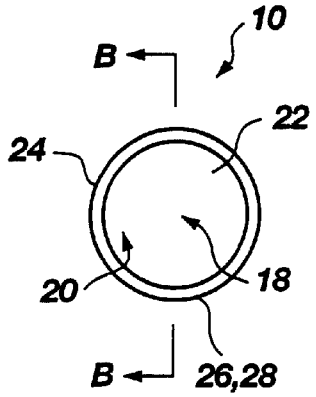
FIG. 3A comprises a frontal view of a small chamfer PDC cutter usable with the present invention, and FIG. 3B comprises a side sectional view of the small chamfer PDC cutter of FIG. 3A, taken along section lines B—B.
Figure 3B:
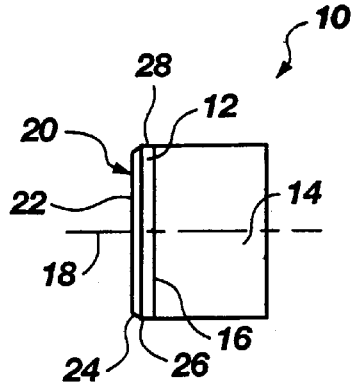

FIGS. 3A and 3B depict an exemplary "small chamfer" cutter 10 comprised of a superabrasive, PDC diamond table 12 supported by a tungsten carbide (WC) substrate 14, as known in the art. The interface 16 between the PDC diamond table 12 and the substrate 14 may be planar or nonplanar, according to many varying designs for same as known in the art. Cutter 10 is substantially cylindrical and symmetrical about longitudinal axis 18, although such symmetry is not required and nonsymmetrical cutters are known in the art. Cutting face 20 of cutter 10, to be oriented on a bit facing generally in the direction of bit rotation, extends substantially transversely to such direction and to axis 18. The surface 22 of the central portion of cutting face 20 is planar as shown, although concave, convex, ridged or other substantially, but not exactly, planar surfaces may be employed. A chamfer 24 extends from the periphery of surface 22 to cutting edge 26 at the sidewall 28 of cutter diamond table 12. Chamfer 24 and cutting edge 26 may extend about the entire periphery of diamond table 12 or only along a periphery portion to be located adjacent the formation to be cut. Chamfer 24 may comprise the aforementioned 0.010 of an inch by 45° conventional chamfer, or the chamfer may lie at some other angle, as referenced with respect to the chamfer 124 of cutter 110 described below. While 0.010 of an inch chamfer size is referenced as an example (within conventional tolerances), chamfer sizes within a range of 0.005 to about 0.020 of an inch are contemplated as generally providing a "small" chamfer for the practice of the invention. It should also be noted that cutters exhibiting substantially no visible chamfer may be employed for certain applications in selected outer regions of the bit.

Figure 4:
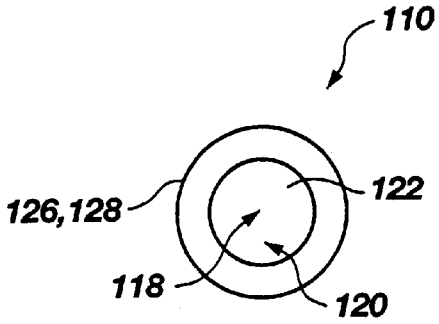
FIG. 4 comprises a frontal view of a large chamfer PDC cutter usable with the present invention.
Figure 5:
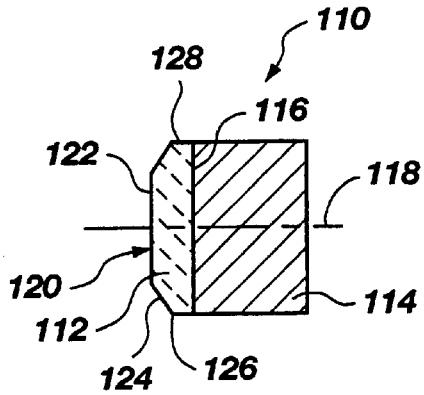
FIG. 5 comprises a side sectional view of a first internal configuration for the large chamfer PDC cutter of FIG. 4.
Figure 6:
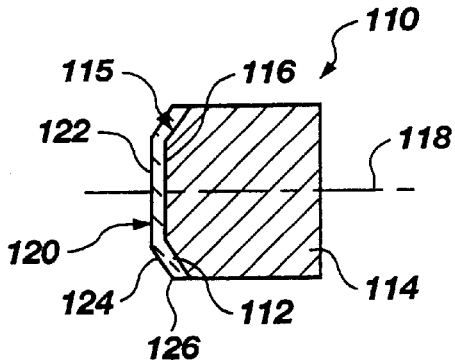
FIG. 6 comprises a side sectional view of a second internal configuration for the large chamfer PDC cutter of FIG. 4.
Figure 7:
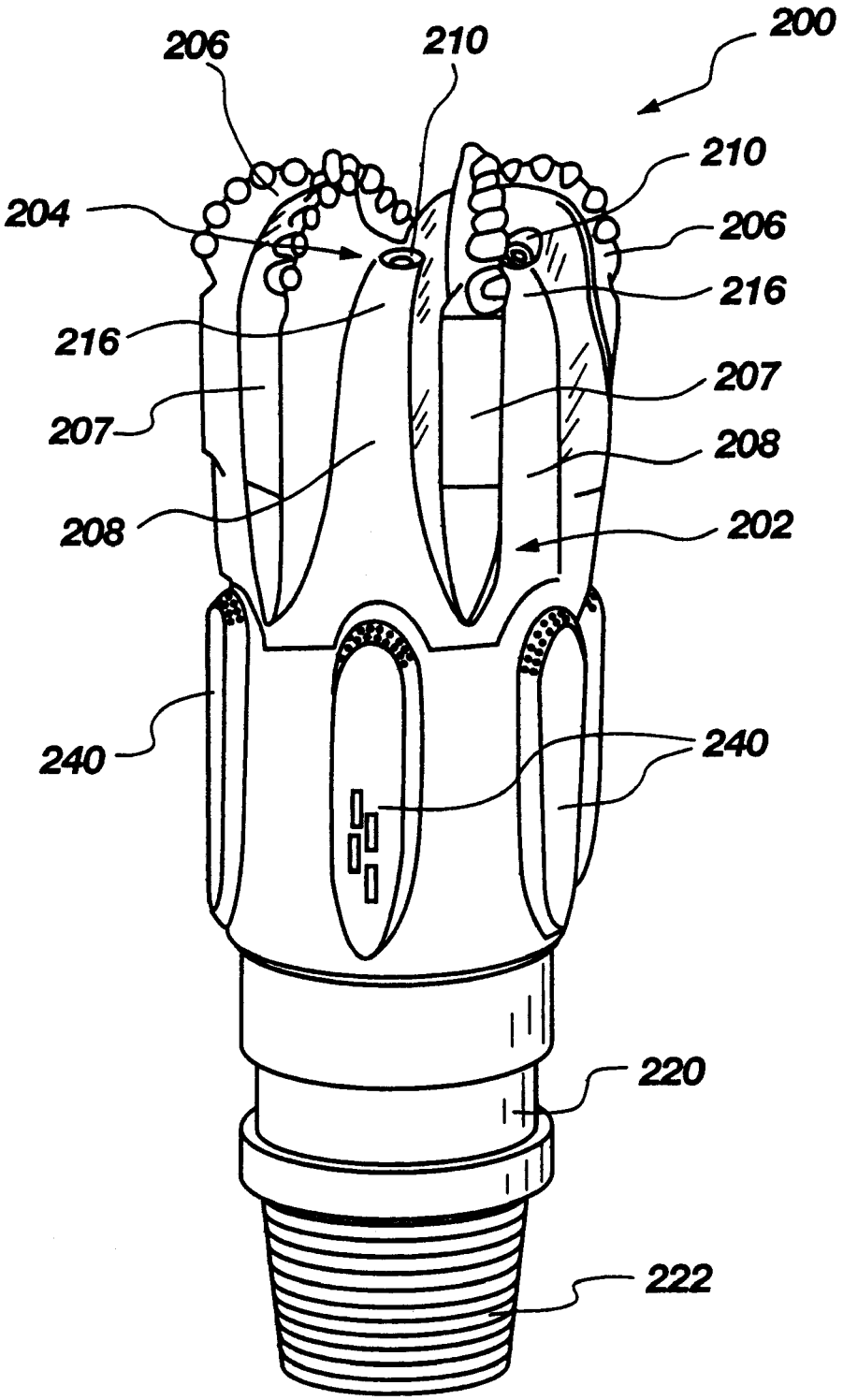
FIG. 7 comprises a side perspective view of a PDC-equipped rotary drag bit according to one embodiment of the present invention.
Figure 8:
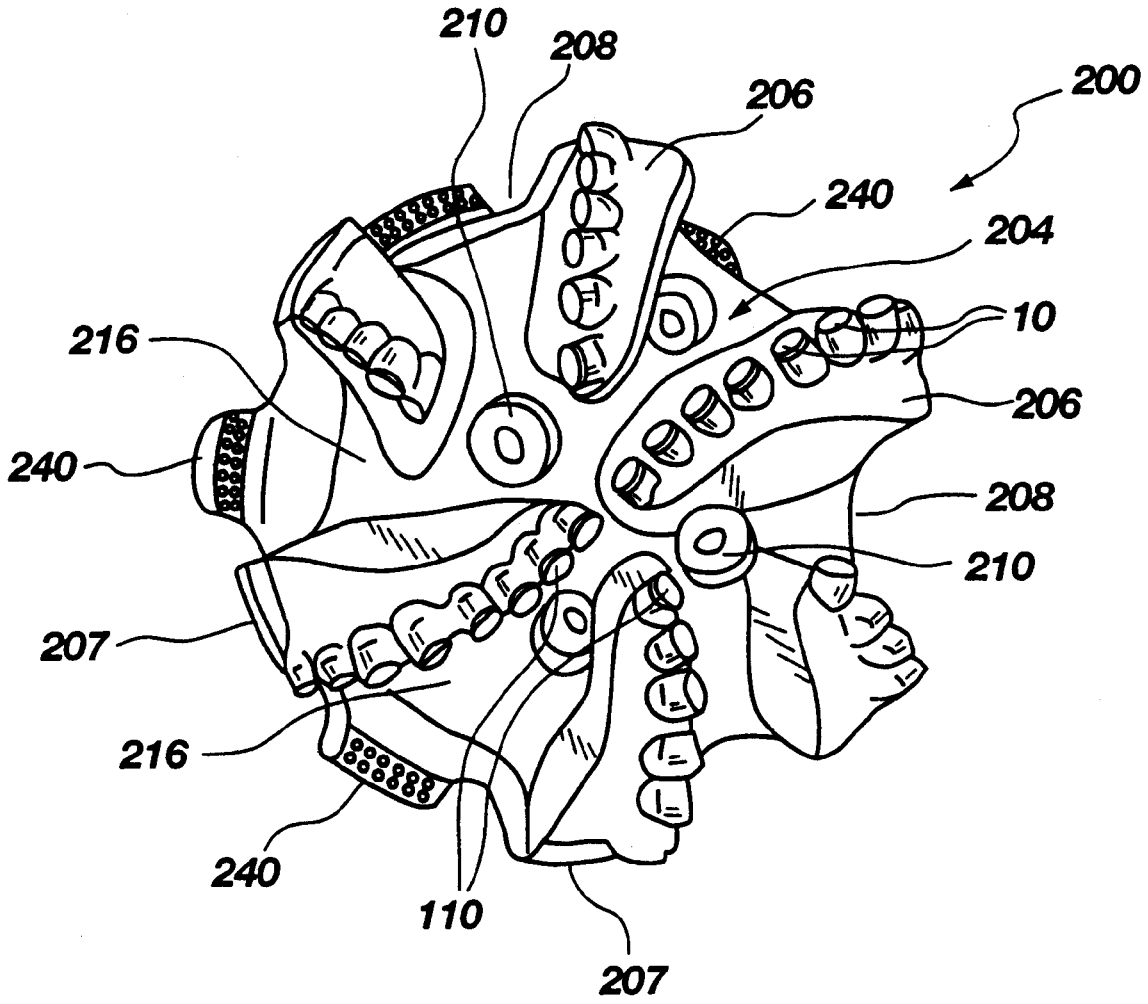
FIG. 8 comprises a face view of the bit of FIG. 7.

FIGS. 4 through 6 depict an exemplary "large chamfer" cutter 110 comprised of a superabrasive, PDC diamond table 112 supported by a WC substrate 114. The interface 116 between the PDC diamond table 112 and the substrate 114 may be planar or nonplanar, according to many varying designs for interfaces known in the art (see especially FIGS. 5 and 6). Cutter 110 is substantially cylindrical and symmetrical about longitudinal axis 118, although such symmetry is not required and nonsymmetrical cutters are known in the art. Cutting face 120 of cutter 110, to be oriented on a bit facing generally in the direction of bit rotation, extends substantially transversely to such direction and to longitudinal axis 118. The surface 122 of the central portion of cutting face 120 is planar as shown, although concave, convex, ridged or other substantially, but not exactly, planar surfaces may be employed. A chamfer 124 extends from the periphery of surface 122 to cutting edge 126 at the sidewall 128 of diamond table 112. Chamfer 124 and cutting edge 126 may extend about the entire periphery of diamond table 112 or only along a periphery portion to be located adjacent the formation to be cut. Chamfer 124 may comprise a surface oriented at 45° to longitudinal axis 118, of a width, measured radially and looking at and perpendicular to the cutting face 120, ranging upward in magnitude from about 0.030 of an inch, and generally lying within a range of about 0.030 to 0.060 of an inch in width. Chamfer angles of about 10° to about 80° to longitudinal axis 118 are believed to have utility, with angles in the range of about 30° to about 60° being preferred for most applications. The effective angle of a chamfer relative to the formation face being cut may also be altered by changing the backrake of a cutter.

FIG. 5 illustrates one internal configuration for cutter 110, wherein diamond table 112 is extremely thick, on the order of 0.070 of an inch or greater, in accordance with the teachings of the above-referenced U.S. Pat. No. 5,706,906 to Jurewicz et al.

FIG. 6 illustrates a second internal configuration for cutter 110, wherein the front face 115 of substrate 114 is frustoconical in configuration, and diamond table 112, of substantially constant depth, substantially conforms to the shape of front face 115 to provide a large chamfer of a desired width without requiring the large PDC diamond mass of U.S. Pat. No. 5,706,906 to Jurewicz et al.

FIGS. 7 through 10 depict a rotary drag bit 200 according to the invention. Bit 200 includes a body 202 having a face 204 and including a plurality (in this instance, six) of generally radially oriented blades 206 extending above the bit body face 204 to a gage 207. Junk slots 208 lie between adjacent blades 206. A plurality of nozzles 210 provides drilling fluid from plenum 212 within the bit body 202 and received through passages 214 to the bit body face 204. Formation cuttings generated during a drilling operation are transported by the drilling fluid across bit body face 204 through fluid courses 216 communicating with respective junk slots 208. Secondary gage pads 240 are rotationally and substantially longitudinally offset from blades 206 and provide additional stability for bit 200 when drilling both linear and nonlinear borehole segments. Such added stability reduces the incidence of ledging of the borehole sidewall and spiraling of the borehole path. Shank 220 includes a threaded pin connection 222 as known in the art, although other connection types may be employed.

Figure 10:
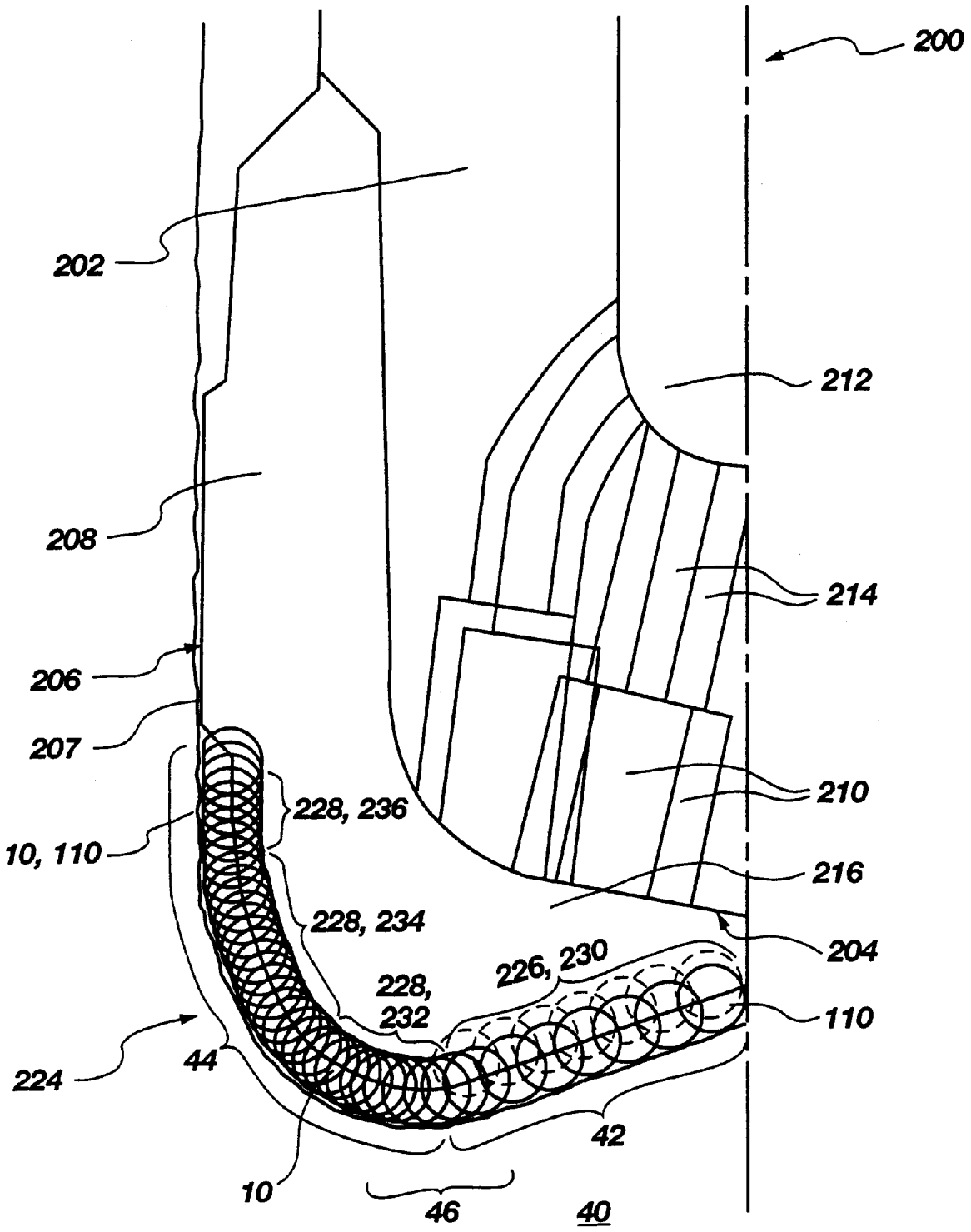
FIG. 10 comprises a quarter-sectional side schematic of a bit having a profile such as that of FIG. 7, with the cutter locations rotated to a single radius extending from the bit centerline to the gage to show the radial bit face locations of the various cutter chamfer sizes and angle and cutter backrake angles employed in the bit.

The profile 224 of the bit body face 204 as defined by blades 206 is illustrated in FIG. 10, wherein bit 200 is shown adjacent a subterranean rock formation 40 at the bottom of the well bore. First region 226 and second region 228 of profile 224 face adjacent rock zones 42 and 44 of formation 40 and respectively carry large chamfer cutters 110 and small chamfer cutters 10. First region 226 may be said to comprise the cone 230 of the bit profile 224 as illustrated, whereas second region 228 may be said to comprise the nose 232 and flank 234 and extend to and include shoulder 236 of profile 224, terminating at gage 207.

Figure 9:
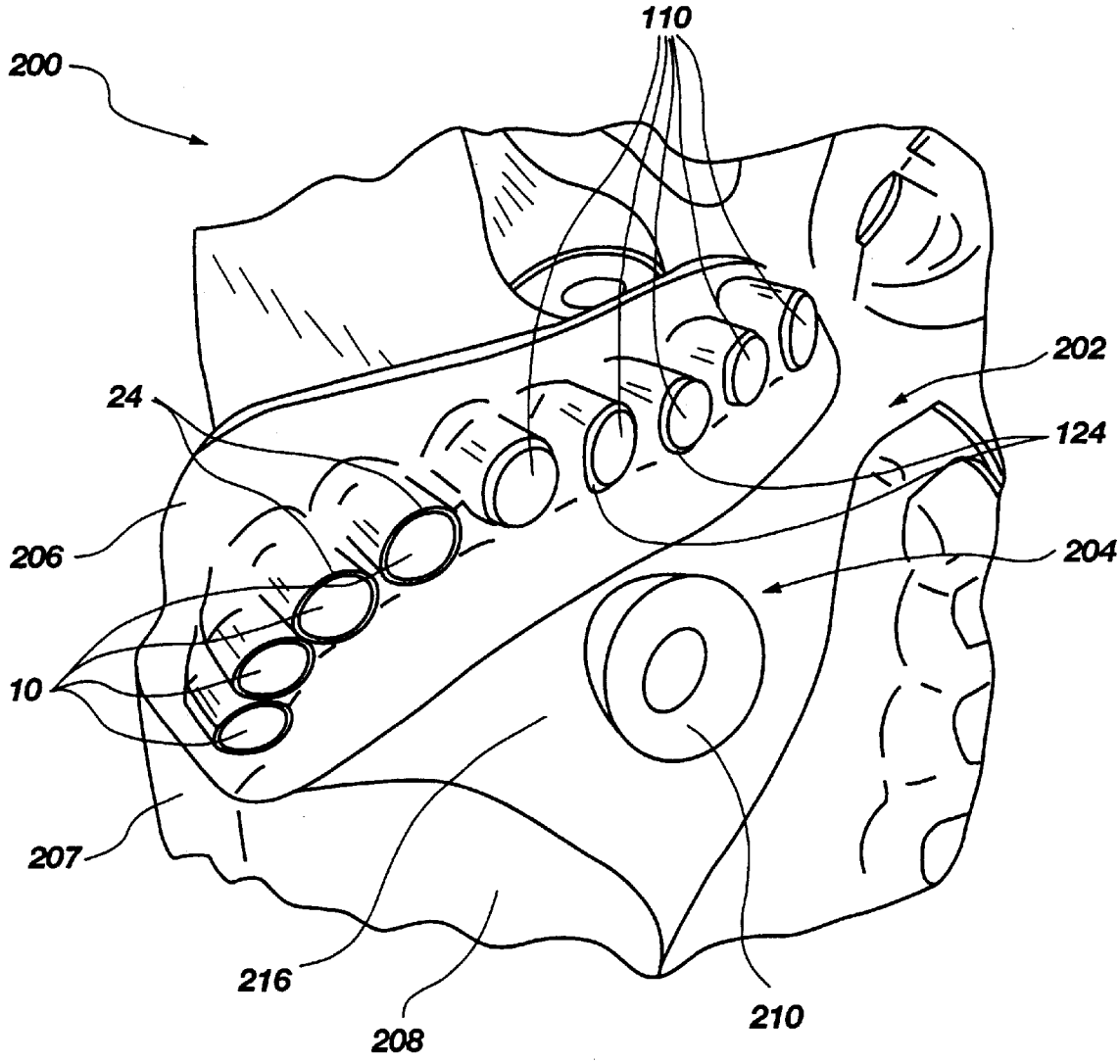
FIG. 9 comprises an enlarged, oblique face view of a single blade of the bit of FIG. 8, illustrating the varying cutter chamfer sizes and angles and cutter rake angles employed.

In a currently preferred embodiment of the invention and with particular reference to FIGS. 9 and 10, large chamfer cutters 110 may comprise cutters having PDC tables in excess of 0.070 of an inch in depth, and preferably about 0.080 to 0.090 of an inch in depth, with chamfers 124 of about a 0.030 to 0.060 of an inch width, looking at and perpendicular to the cutting face 120, and oriented at a 45° angle to the cutter axis 118. The cutters themselves, as disposed in first region 226, are backraked at 20° to the bit profile (see cutters 110 shown partially in broken lines in FIG. 10 to denote 20° backrake) at each respective cutter location, thus providing chamfers 124 with a 65° backrake. Cutters 10, on the other hand, disposed in second region 228, may comprise conventionally chamfered cutters having about a 0.030 of an inch PCD table thickness and about a 0.010 to 0.020 of an inch chamfer width looking at and perpendicular to cutting face 20, with chamfers 24 oriented at a 45° angle to the cutter axis 18. Cutters 10 are themselves backraked at 15° on nose 232 providing a 60° chamfer backrake, while cutter backrake is further reduced to 10° at the flank 234, shoulder 236 and on the gage 207 of bit 200, resulting in a 55° chamfer backrake. The PDC cutters 10 immediately above gage 207 include preformed flats thereon oriented parallel to the longitudinal axis of the bit 200, as known in the art. In steerable applications requiring greater durability at the shoulder 236, large chamfer cutters 110 may optionally be employed, but oriented at a 10° cutter backrake. Further, the chamfer angle of cutters 110 in each of regions 226 and 228 may be other than 45°. For example, 70° chamfer angles may be employed with chamfer widths (looking vertically at the cutting face of the cutter) in the range of about 0.035 to 0.045 inch, cutters 110 being disposed at appropriate backrakes to achieve the desired chamfer rake angles in the respective regions.

A boundary region, rather than a sharp boundary, may exist between first and second regions 226 and 228. For example, rock zone 46 bridging the adjacent edges of rock zones 42 and 44 of formation 40 may comprise an area wherein demands on cutters and the strength of the formation are always in transition due to bit dynamics. Alternatively, the rock zone 46 may initiate the presence of a third region on the bit profile wherein a third size of cutter chamfer is desirable. In any case, the annular area of profile 224 opposing rock zone 46 may be populated with cutters of both types (i.e., width and chamfer angle) employing backrakes respectively in region 226 and region 228, or cutters with chamfer sizes, angles and cutter backrakes intermediate those of the cutters in regions 226 and 228 may be employed.

Bit 200, equipped as described with a combination of small chamfer cutters 10 and large chamfer cutters 110, will drill with an ROP approaching that of conventional, nondirectional bits equipped only with small chamfer cutters but will maintain superior stability and will drill far faster than a conventional directional drill bit equipped only with large chamfer cutters.

Figure 1:
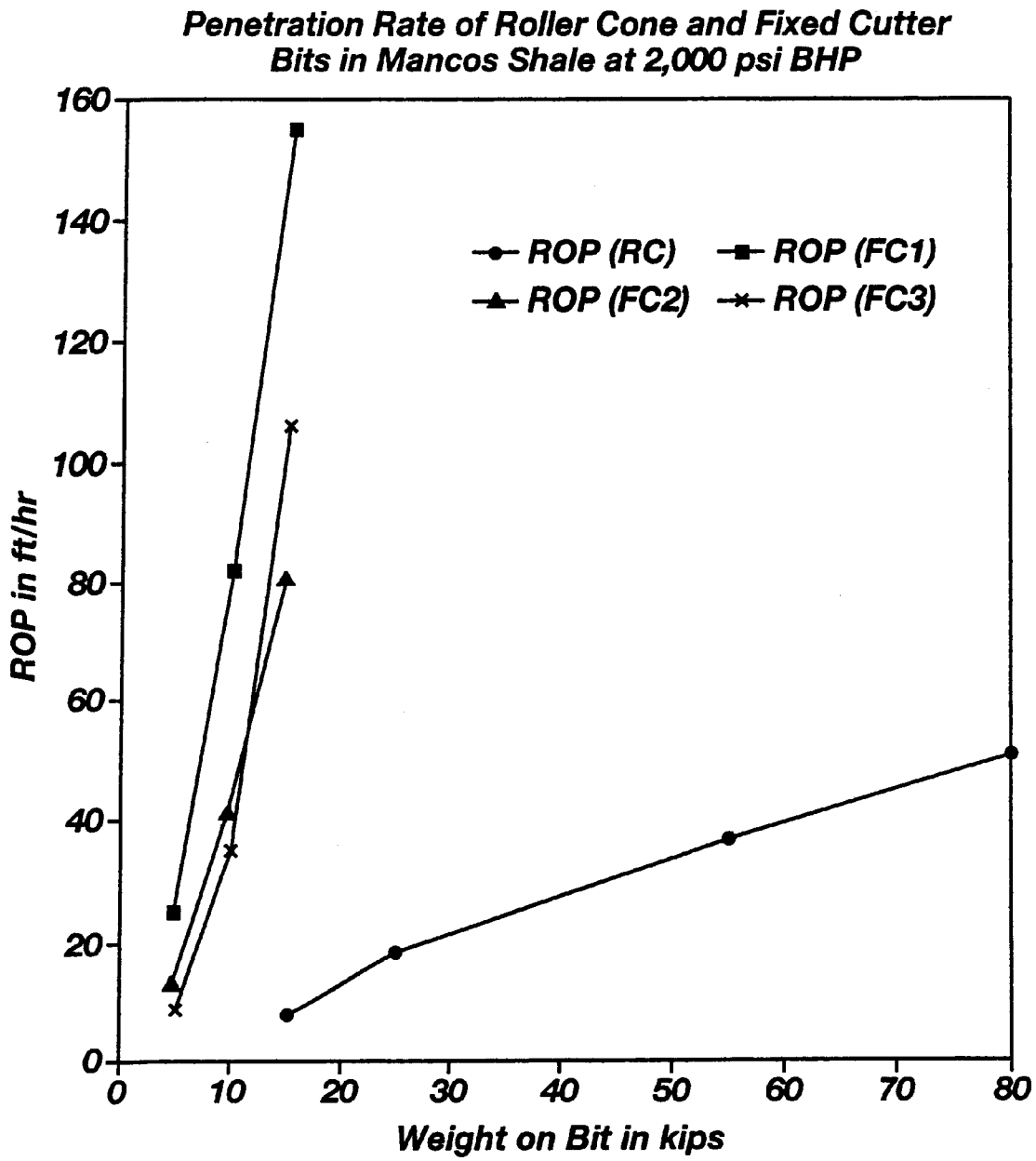
FIG. 1 comprises a graphical representation of ROP versus WOB characteristics of various rotary drill bits in drilling Mancos Shale at 2000 psi bottomhole pressure.
Figure 2:
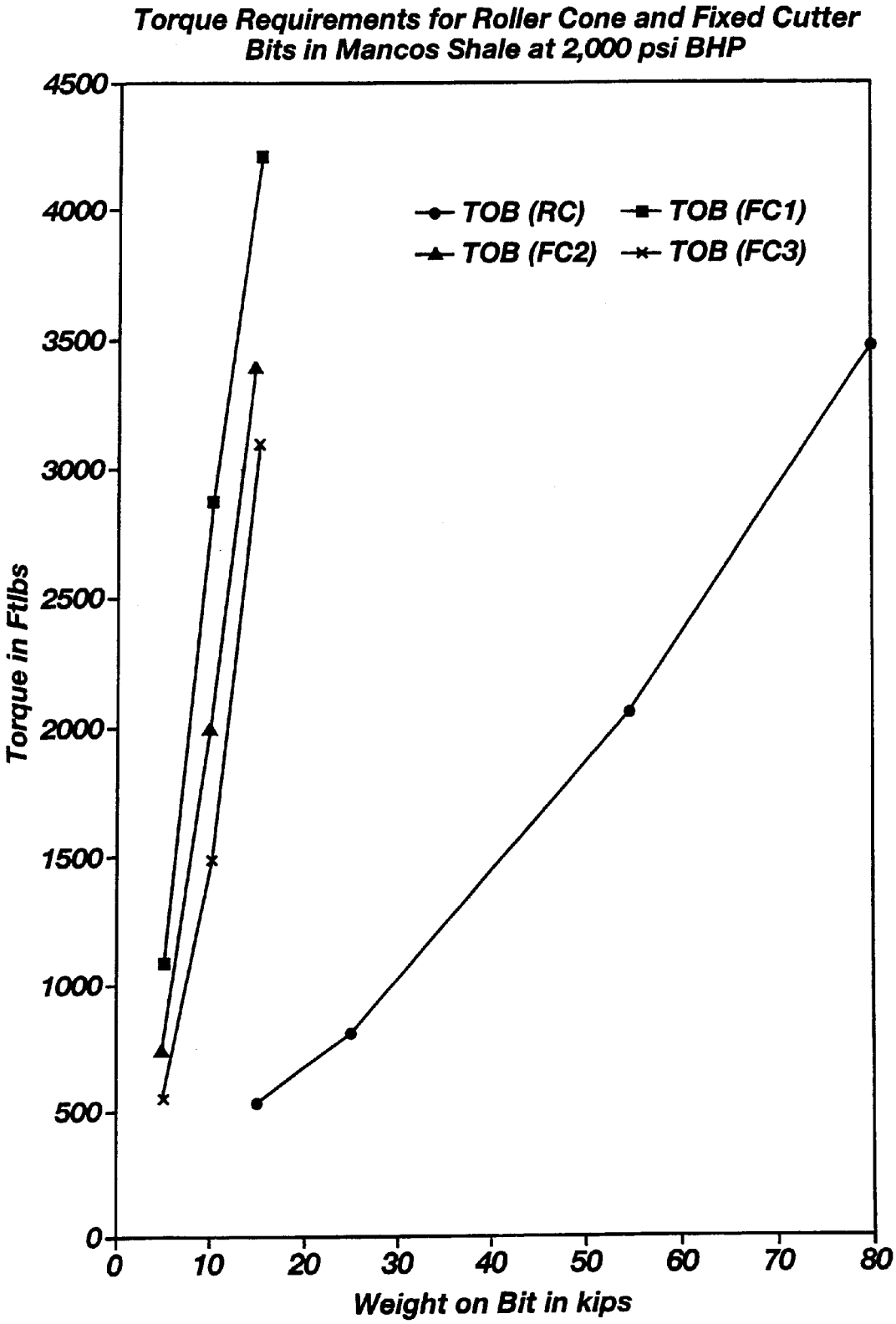
FIG. 2 comprises a graphical representation of TOB versus WOB characteristics of various rotary drill bits in drilling Mancos Shale at 2,000 psi bottomhole pressure.

It is believed that the benefits achieved by the present invention result from the aforementioned effects of selective variation of chamfer size, chamfer backrake angle and cutter backrake angle. For example and with specific reference to FIG. 11, the size (width) of the chamfer 124 of the large chamfer cutters 110 at the center of the bit can be selected to maintain nonaggressive characteristics in the bit up to a certain WOB or ROP, denoted in FIGS. 1 and 2 as the "break" in the curve slopes for bit FC3. For equal chamfer backrake angles β1, the larger the chamfer 124, the greater the WOB that must be applied before the bit enters the second, steeper-sloped portions of the curves. Thus, for drilling nonlinear borehole segments, wherein applied WOB is generally relatively low, it is believed that a nonaggressive character for the bit may be maintained by drilling to a first depth of cut (DOC1) associated with a relatively low WOB wherein the cut is taken substantially within the chamfer 124 of the large chamfer cutters 110 disposed in the center region of the bit. In this instance, the effective backrake angle of the cutting face 120 of cutter 110 is the chamfer backrake angle β1, and the effective included angle γ1 between the cutting face 120 and the formation 300 is relatively small. For drilling linear borehole segments, WOB is increased so that the depth-of-cut (DOC2) extends above the chamfers 124 on the cutting faces 120 of the large chamfer cutters to provide a larger effective included angle γ2 (and smaller effective cutting face backrake angle β2) between the cutting face 120 and the formation 300, rendering the cutters 110 more aggressive and thus increasing ROP for a given WOB above the break point of the curve of FIG. 1. As shown in FIG. 2, this condition is also demonstrated by a perceptible increase in the slope of the TOB versus WOB curve above a certain WOB level. Of course, if a chamfer 124 is excessively large, excessive WOB may have to be applied to cause the bit to become more aggressive and increase ROP for linear drilling.

The chamfer backrake angle β1 of the large chamfer cutters 110 may be employed to control DOC for a given WOB below a threshold WOB wherein DOC exceeds the chamfer depth perpendicular to the formation. The smaller the included angle γ1 between the chamfer 124 and the formation 300 being cut, the more WOB being required to effect a given DOC. Further, the chamfer backrake angle β1 predominantly determines the slopes of the ROP\WOB and TOB\WOB curves of FIGS. 1 and 2 at low WOB and below the breaks in the curves, since the cutters 110 apparently engage the formation to a DOC1 residing substantially within the chamfer 124.

Further, selection of the backrake angles δ of the cutters 110 themselves (as opposed to the backrake angles β1 of the chamfers 124) may be employed to predominantly determine the slopes of the ROP\WOB and TOB\WOB curves at high WOB and above the breaks in the curves, since the cutters 110 will be engaged with the formation to a DOC2 such that portions of the cutting face centers of the cutters 120 (i.e., above the chamfers 124) will be engaged with the formation 300. Since the central areas of the cutting faces 120 of the cutters 110 are oriented substantially perpendicular to the longitudinal axes 118 of the cutters 110, cutter backrake angle δ will largely dominate effective cutting face backrake angles (now β2) with respect to the formation 300, regardless of the chamfer backrake angles β1. As noted previously, cutter backrake angles δ may also be used to alter the chamfer backrake angles β1 for purposes of determining bit performance during relatively low WOB drilling.

It should be appreciated that appropriate selection of chamfer size and chamfer backrake angle of the large chamfer cutters may be employed to optimize the performance of a drill bit with respect to the output characteristics of a downhole motor driving the bit during steerable or nonlinear drilling of a borehole segment. Such optimization may be effected by choosing a chamfer size so that the bit remains nonaggressive under the maximum WOB to be applied during steerable or nonlinear drilling of the formation or formations in question, and choosing a chamfer backrake angle so that the torque demands made by the bit within the applied WOB range during such steerable drilling do not exceed torque output available from the motor, thus avoiding stalling.

With regard to the placement of cutters exhibiting variously sized chamfers on the exterior, and specifically the face, of a bit, the chamfer widths employed on different regions of the bit face may be selected in proportion to cutter redundancy, or density, at such locations. For example, a center region of the bit, such as within a cone surrounding the bit centerline (see FIGS. 7 through 10 and above discussion) may have only a single cutter (allowing for some radial cutter overlap) at each of several locations extending radially outward from the centerline or longitudinal axis of the bit. In other words, there is only "single" cutter redundancy at such cutter locations. An outer region of the bit, portions of which may be characterized as comprising a nose, flank and shoulder, may, on the other hand, exhibit several cutters at substantially the same radial location. It may be desirable to provide three cutters at substantially a single radial location in the outer region, providing substantially triple cutter redundancy. In a transition region between the inner and outer regions, such as on the boundary between the cone and the nose, there may be an intermediate cutter redundancy, such as substantially double redundancy, or two cutters at substantially each radial location in that region.

Relating cutter redundancy to chamfer width for exemplary purposes in regard to the present invention, cutters at single redundancy locations may exhibit chamfer widths of between about 0.030 to 0.060 of an inch, while those at double redundancy locations may exhibit chamfer widths of between about 0.020 and 0.040 of an inch, and cutters at triple redundancy locations may exhibit chamfer widths of between about 0.010 and 0.020 of an inch.

Figure 12:
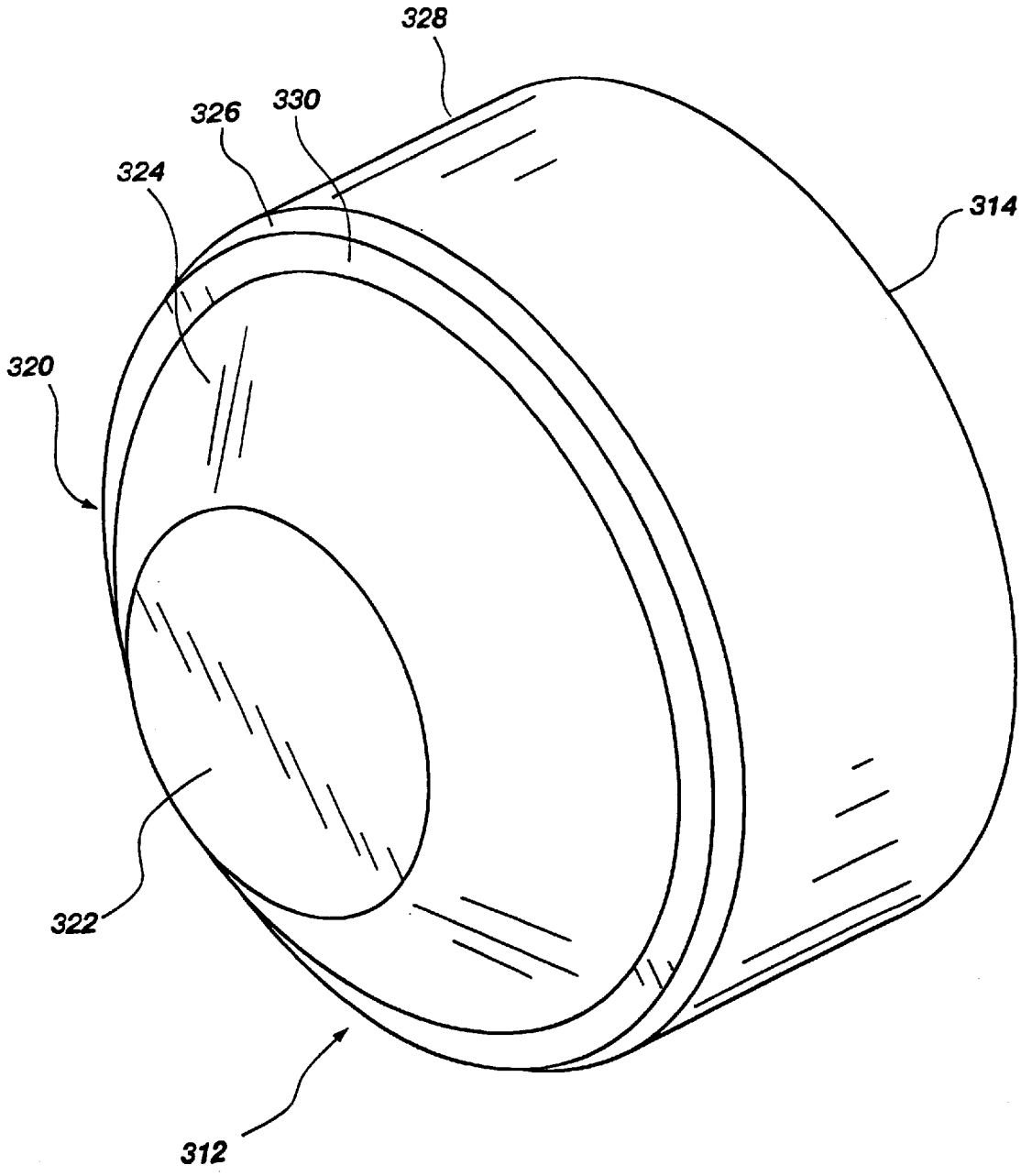
FIG. 12 is a frontal perspective view of a superabrasive table shown in isolation comprising a first exemplary multi-aggressive cutting face particularly suitable for use in practicing the present invention.
Figure 13:
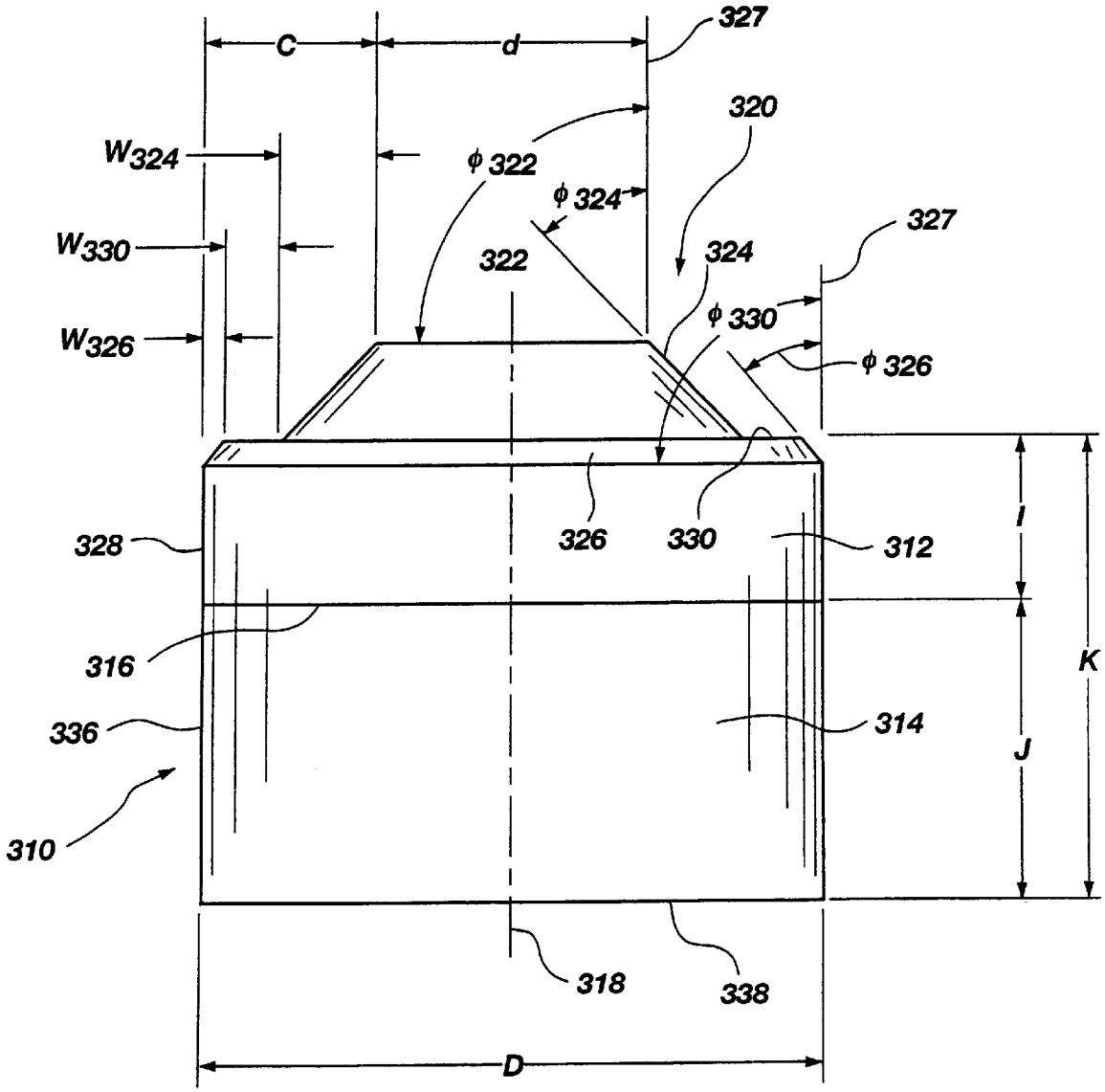
FIG. 13 is a side view of a cutting element incorporating the superabrasive table shown in FIG. 12.

Backrake angles of cutters in relation to their positions on the bit face have previously been discussed with regard to FIGS. 7 through 10. However, it will be appreciated that differences in the chamfer angles from the exemplary 45° angles discussed above may necessitate differences in the relative cutter backrake angles employed in, and within, the different regions of the bit face in comparison to those of the example. 641 FIGS. 12–15 of the drawings illustrate a cutting element particularly suitable for use in drilling a borehole through formations ranging from relatively hard formations to relatively soft formations in accordance with a method of the present invention. Cutting element, or cutter, 310 comprises a superabrasive table 312 disposed onto metallic carbide substrate 314 using materials and high-pressure, high-temperature fabrication methods known within the art. Materials such as polycrystalline diamond (PCD) may be used for superabrasive table 312 and tungsten carbide (WC) may be used for substrate 314; however, various other materials known within the art may be used in lieu of the preferred materials. Such alternative materials suitable for superabrasive table 312 include, for example, thermally stable product (TSP), diamond film, cubic boron nitride and related $C_3N_4$ structures. Alternative materials suitable for substrate 314 include cemented carbides such as tungsten (W), niobium (Nb), zirconium (Zr), vanadium (V), tantalum (Ta), titanium (Ti), and hafnium (Hf). Interface 316 denotes the boundary, or junction, between superabrasive table 312 and substrate 314 and imaginary longitudinal axis, or centerline, 318 denotes the longitudinal centerline of cutting element 310. Superabrasive table 312 has an overall longitudinal length denoted as dimension I and substrate 314 has an overall longitudinal length denoted as dimension J, resulting in cutter 310 having an overall length K as shown in FIG. 13. Substrate 314 has an exterior sidewall 336 and superabrasive table 312 has an exterior sidewall 328 which are preferably of the same diameter, denoted as dimension D, as depicted in FIG. 13, and are concentric and parallel with centerline 318. Superabrasive or diamond table 312 is provided with a multi-aggressive cutting face 320 which, as viewed in FIG. 12, is exposed so as to be generally transverse to longitudinal axis 318.

Figure 14:
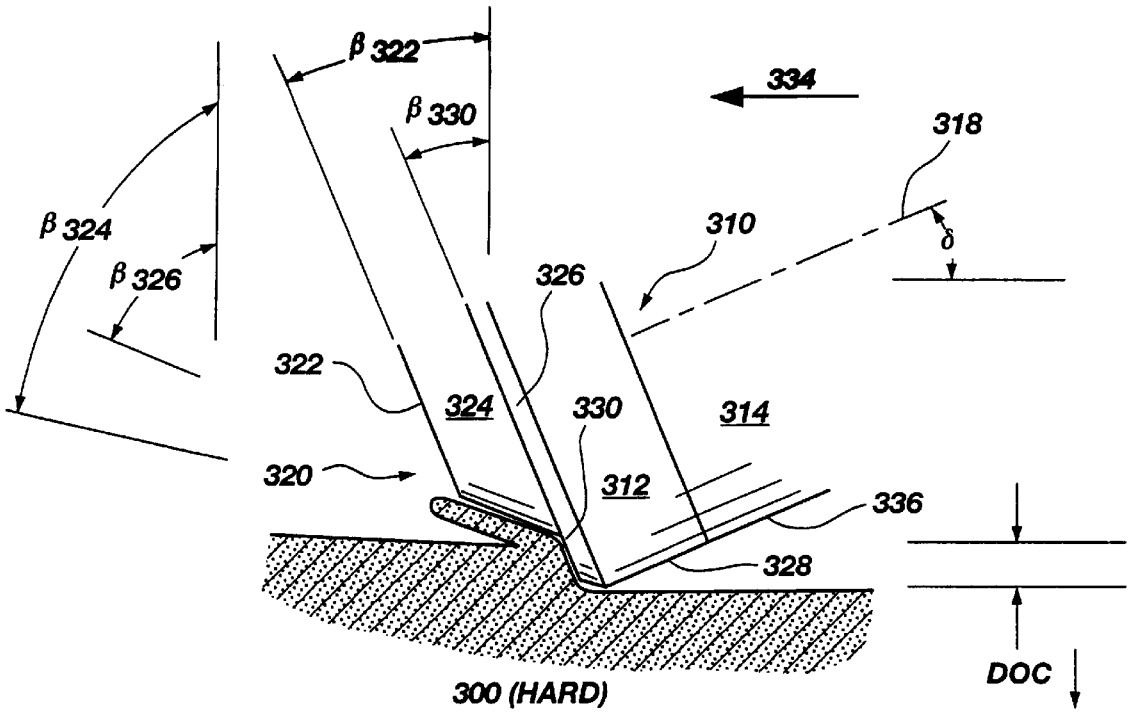
FIG. 14 is a side view of the cutting element shown in FIG. 13 as the multi-aggressive aggressive cutting face engages a relatively hard formation at a relatively small depth of cut (DOC) in accordance with the present invention.
Figure 15:
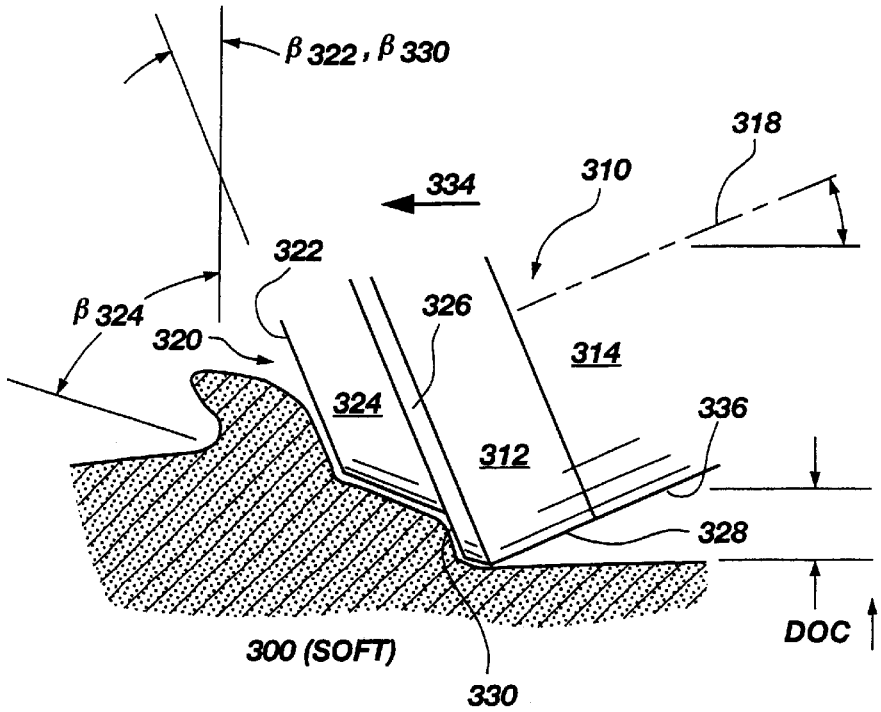
FIG. 15 is a side view of the cutting element shown in FIGS. 13 and 14 as the multi-aggressive cutting face engages a relatively soft formation at a relatively large depth of cut (DOC) in accordance with the present invention.

Multi-aggressive cutting face 320 preferably comprises: a radially outermost, full circumference, less aggressive sloped surface, or chamfer 326; a generally full circumference, aggressive cutting surface, or shoulder 330; a radially and longitudinally intermediate, generally full-circumference, intermediately aggressive sloped cutting surface 324; and an aggressive, radially innermost, or centermost, cutting surface 322. Radially outermost sloped surface, or chamfer 326, as shown in FIGS. 13–15, is angled with respect to sidewall 328 of superabrasive table 312 which is preferably, but not necessarily, parallel to longitudinal axis, or centerline, 318 which is generally perpendicular to back surface 338 of substrate 314. The angle of chamfer 326, denoted as $\phi_{326}$, as well as the angle of slope of other cutting surfaces shown and described herein is measured with respect to a reference line 327 extending upwardly from exterior sidewall 328. Vertically extending reference line 327 is parallel to longitudinal axis 318; however, it will be understood by those in the art that chamfer angles can be measured from other reference lines or data. For example, chamfer angles can be measured directly with respect to the longitudinal axis, or to a vertical reference line shifted radially inwardly from the sidewall of the cutter, or with respect to back surface 338. Chamfer angles, or cutting surface angles, as described and illustrated herein will generally be as measured from a vertically extending reference line parallel to the longitudinal axis. The width of chamfer 326 is denoted by dimension $W_{326}$ as illustrated in FIG. 13. Peripheral cutting surface, or shoulder, 330, being of a width $W_{330}$ is preferably, but not necessarily, perpendicular to longitudinal axis 318 and thus will be generally perpendicular to sidewall 328. Sloped cutting surface-324, being of a selected height and a width $W_{324}$, is angled with respect to the sidewall 328 so as to have a reference angle of $\phi_{324}$. If desired for manufacturing convenience, the angle of slope of sloped cutting surface 324 and chamfer 326 can alternatively be measured with respect to back surface 338. Radially innermost, cutting surface 322, having a diameter d is preferably, but not necessarily perpendicular to longitudinal axis 318 and thus is generally parallel to back surface 338 of substrate 314. Centermost cutting surface 322 is preferably planar and is sized so that diameter d is less than substrate/table, or cutter, diameter D and thus is radially inset from sidewall 328 by a distance C.

The following dimensions are representative of an exemplary multi-aggressive cutter 310 having a PDC superabrasive table 312 with a thickness preferably ranging between approximately 0.070 of an inch to 0.175 of an inch or greater with approximately 0.125 of an inch being well-suited for many applications. Superabrasive table 312 has been bonded onto a tungsten carbide (WC) substrate 314 having a diameter D that would provide a multi-aggressive cutting element suitable for drilling formations within a wide range of hardness. Such exemplary dimensions and angles are: D—ranging from approximately 0.020 of an inch to approximately 1 inch or more with approximately 0.25 to approximately 0.75 of an inch being well-suited for a wide variety of applications; d—ranging from approximately 0.100 to approximately 0.200 of an inch with approximately 0.150 to approximately 0.175 of an inch being well-suited for a wide variety of applications; $W_{326}$—ranging from approximately 0.005 to approximately 0.020 of an inch with approximately 0.010 to approximately 0.015 of an inch being well-suited for a wide variety of applications; $W_{324}$—ranging from approximately 0.025 to approximately 0.075 of an inch with approximately 0.040 to 0.060 of an inch being well-suited for a wide variety of applications; $W_{330}$—ranging from approximately 0.025 to approximately 0.075 of an inch with 0.040 to approximately 0.060 of an inch being well-suited for a wide variety of applications; $\phi_{326}$—ranging from approximately 30° to approximately 60° with approximately 45° being well-suited for a wide variety of applications; and $\phi_{324}$—ranging from approximately 30° to approximately 60° with approximately 45° being well-suited for a wide variety of applications. However, it should be understood that other dimensions and angles of these ranges can readily be used depending on the degree, or magnitude, of aggressivity desired for each cutting surface, which in turn will influence the DOC of that cutting surface at a given WOB in a formation of a particular hardness. Furthermore the dimensions and angles may also be specifically tailored so as to modify the radial and longitudinal extent each particular cutting surface is to have and thus induce a direct affect on the overall aggressiveness, or aggressivity profile, of cutting face 320 of exemplary cutting element 310.

Figure 18:
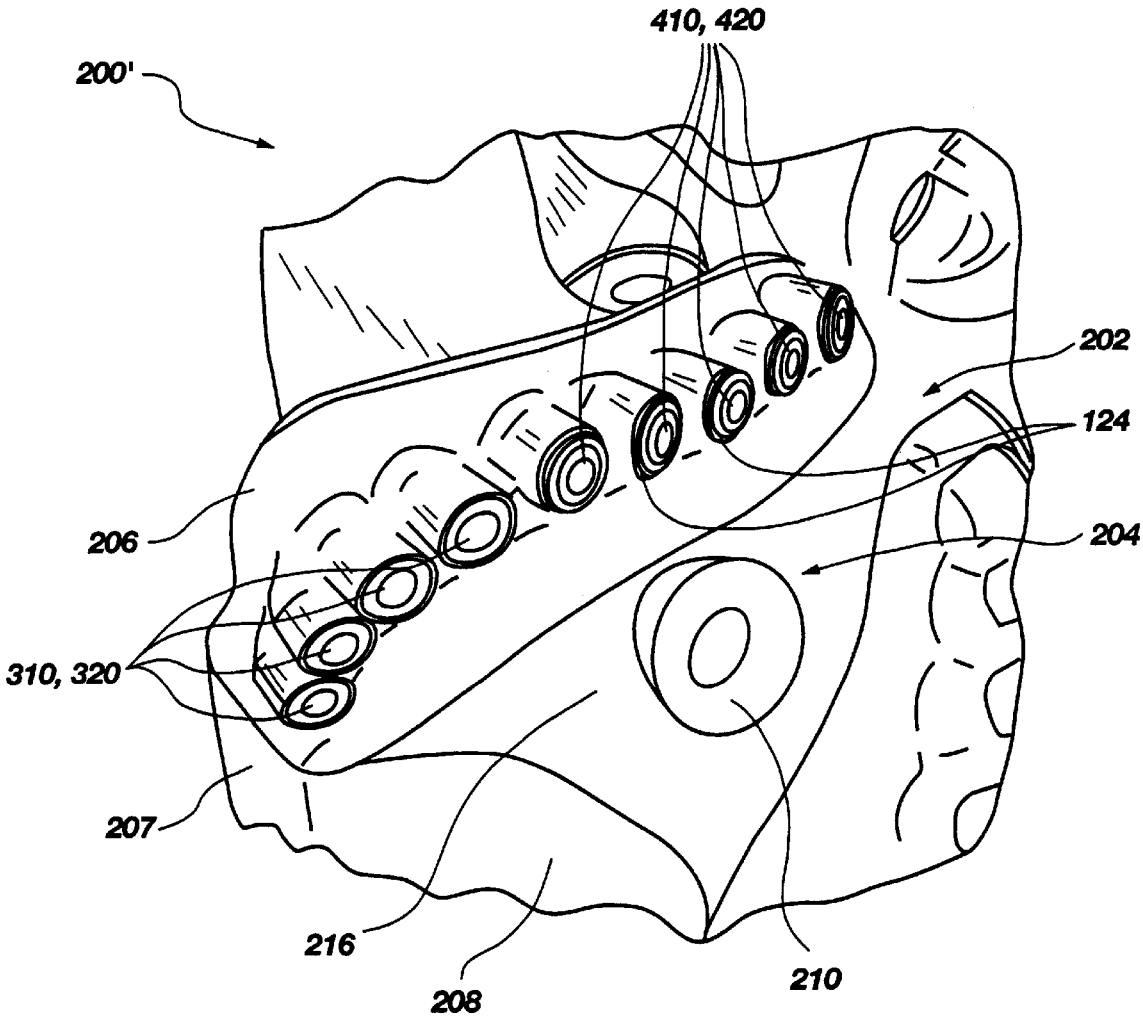
FIG. 18 is a view of an isolated portion of the face of a representative drag bit comprising, as a nonlimiting example, cutting elements installed on a blade thereof which respectively comprise cutting faces configured to have differing multi-aggressive profiles.

A plurality of cutting elements 310, each having a multi-aggressive cutting face 320, is shown as being mounted in a drag bit such as a drag bit 200' illustrated in FIG. 18. The illustrative arrangement of cutting elements 310 is not restricted to the particular arrangement shown in FIG. 18, but is referenced for illustrating that each cutter 310 is installed in a drill bit, such as representative bit 200', at a selected respective cutter backrake angle δ which may be positive, neutral, or negative. As described previously, it is typically preferred that backrake angles δ be negative in value, i.e., angled "backward" with respect to the direction of intended bit rotation 334 as shown in FIGS. 14 and 15. The respective backrake angles δ of cutters 310 as mounted in representative drag bit 200' will, of course, be influenced by the angles, $\phi_{324}$ and $\phi_{326}$ that have been selected for cutting surfaces 324, as well as angles $\phi_{330}$ and $\phi_{322}$ which cutting surfaces 322 and 330 may have in lieu of being perpendicular, or 90°, to longitudinal axis 318. Cutter rake angle, or cutter backrake angle, δ can range anywhere from about 5° to about 50°, with approximately 20° being particularly suitable for a wide range of different types of formations having a wide range of respective hardnesses.

Returning to FIGS. 14 and 15, which illustrate the various backrake angles $\beta_{326}$, $\beta_{330}$, $\beta_{324}$, and $\beta_{322}$ of each of the cutting surfaces comprising cutting face 320 of cutter 310 as the cutter engages a formation in the direction of intended bit rotation 334 during drilling operations. That is, chamfer 326 could be considered as a primary cutting surface when drilling extremely hard formations at a relatively low WOB such as when performing highly deviated directional drilling for example.

In particular, FIG. 14 depicts cutter 310 engaging a relatively hard formation 300 at a given WOB, i.e., holding the WOB at an approximately constant value, so that the DOC is consistent and relatively small dimensionally. By so limiting the DOC, this serves to maximize the ROP considering the hardness of the formation, as well as to extend the life expectancy of cutting elements 310. Because the DOC is relatively small, relatively aggressive cutting surface 330, and to a certain lesser extent chamfer 326, serves as the primary cutting surface to remove the relatively hard formation without generating an undue amount of reactive torque, or TOB. Unwanted or excessive reactive torque will frequently be generated when drilling with conventional, aggressive cutting elements, such as conventionally shaped cylindrical cutting elements having a generally planar cutting face that is perpendicular to the sidewall thereof Such unwanted or excessive reactive torque is prone to occur when drillers attempt to remove too much formation material as the drill bit rotatingly progresses by increasing the WOB, causing conventional cutters to chip and break as discussed earlier. One of the benefits provided in drilling a formation via cutting elements comprising multi-aggressive cutting faces in accordance with the present method becomes noticeably apparent when engaged in directional drilling. This is because the relatively small area of aggressive cutting surface 330, obtained by judiciously selecting an appropriate dimension for width $W_{330}$, results in cutting surface 330 efficiently removing just the right amount of hard formation material at a dimensionally appropriate or optimum DOC without the cutting element unduly or over-aggressively engaging the relatively hard formation thereby generating an unacceptably high TOB.

Upon drilling through a relatively hard formation, or stringer, cutting elements 310 having multi-aggressive cutting faces 320 are readily capable of engaging a relatively soft formation at a larger DOC at a given WOB so as to continue maximizing the ROP without having to change to drill bits having cutters installed thereon which are more suitable for drilling soft formations. An illustration of a cutting element 310 having an exemplary multi-aggressive cutting face 320 engaging a relatively soft formation 300 at a relatively large DOC is shown in FIG. 15. As can be seen in FIG. 15, not only is chamfer 326 and cutting surface 330 engaging formation 300, but sloped cutting surface 324 as well as a portion of centermost cutting surface 322 is substantially engaging the formation so as to remove an even greater volume of formation material with each rotational pass of the drill bit. Thus, for a given WOB, the drilling of the borehole is carried out efficiently, again without generating unwanted reactive torque because the cumulative reactive torque generated by each of the cutting elements is within an acceptable range due to the formation being relatively soft, yet the cutter has an appropriate amount of aggressive cutting surface area, such as cutting surfaces 330 and 322, as well as an appropriate amount of less aggressive cutting surface, such as chamfered surface 326 and sloped cutting surface 324 to maximize ROP without causing the drill bit to rotationally stall and/or cause the bottom hole assembly to lose tool face orientation.

Should the formation become slightly or even substantially harder, the DOC will decrease proportionally because the actual cutting of the formation by cutting face 320 will shift away from centermost cutting surface 322 with less aggressive sloped cutting surface 324 becoming the leadingmost, active cutting surface. If the formation becomes yet harder, the primary leading cutting surface(s) will further shift to peripheral cutting surface 330 and/or chamfer 326 in the very hardest of formations, thereby providing a method of drilling which is self-adapting, or self-modulating, with respect to keeping the TOB within an acceptable range while also maximizing ROP at a given WOB in a formation of any particular hardness. Furthermore, this self-adapting, or self-modulating, aspect of the invention allows the driller to maintain a high degree of tool face control in an economically desirable manner without sacrificing ROP as compared to existing methods of drilling with drill bits equipped with conventional PDC cutting elements.

When engaged in directional drilling, the desired trajectory may require that the steerable bit be oriented to drill at highly deviated angles, or perhaps even in a horizontal manner which frequently precludes increasing WOB beyond a certain limit as opposed to orienting the drill bit in a conventional vertical, or downward, manner where WOB can more readily be increased. Moreover, whether drilling vertically, horizontally, or at an angle therebetween, the present method of drilling with a drill bit equipped with cutting elements comprising multi-aggressive faces that are able to engage the particular formation being drilled at an appropriate level of aggressivity offers the potential to reduce or prevent substantial damage to the drill string and/or a downhole motor as compared to using conventional cutting elements that may be too aggressive for the WOB being applied for the hardness of the formation being drilled and thus lead to excessive and potentially damaging TOB.

Furthermore, when drilling a borehole through a variety of formations wherein each formation has a differing hardness with a drill bit incorporating cutting elements having a multi-aggressive cutting face in accordance with the present invention, the anti-stalling, anti-loss of tool face control of the present invention not only enables drillers to maximize ROP but allows the driller to minimize drilling costs and rig time costs because the need to trip a tool designed for soft formations, or vice versa, out of the borehole will be eliminated. For instance, when drilling a borehole traversing a variety of formations while using a drill bit incorporating cutting elements 310, the dimensional extent of the DOC of each cutting element will be appropriately and proportionately modulated for the relative hardness (or relative softness) of the formation being drilled. This eliminates the need to use drill bits having cutters installed therein to have a specific, single aggressivity in accordance with the teachings of the prior art in lieu of having a variety of cutting surfaces such as cutting surfaces 330, 324, and 322 which respectively and progressively come into play as needed in accordance with the present invention. That is, the "automatic" shifting of the primary, or leading-most cutting surface from the radially outermost periphery of the cutting face progressively to the radially innermost cutting surface, as the formation being drilled goes from very hard to very soft, including any intermediate level of hardness, thereby allows a proportionally larger DOC for soft formations and a proportionally smaller DOC for hard formations for a given WOB. Likewise, cutting surfaces 322, 324, 330 respectively come out of play as the formation being drilled changes from very soft to very hard, thereby allowing a proportionally small DOC as the hardness of the formation increases.

Thus, it can now be appreciated when drilling a borehole through a variety of formations having respectively varying hardness in accordance with the present invention, the drilling supervisor will be able to maintain an acceptable ROP without generating unduly large TOBs by merely adjusting the WOB in response to the hardness of the particular formation being drilled. For example, a hard formation will typically require a larger WOB, for example, approaching 50,000 pounds of force, whereas a soft formation will typically require a much smaller WOB, for example, 20,000 pounds of force or less.

Figure 16:
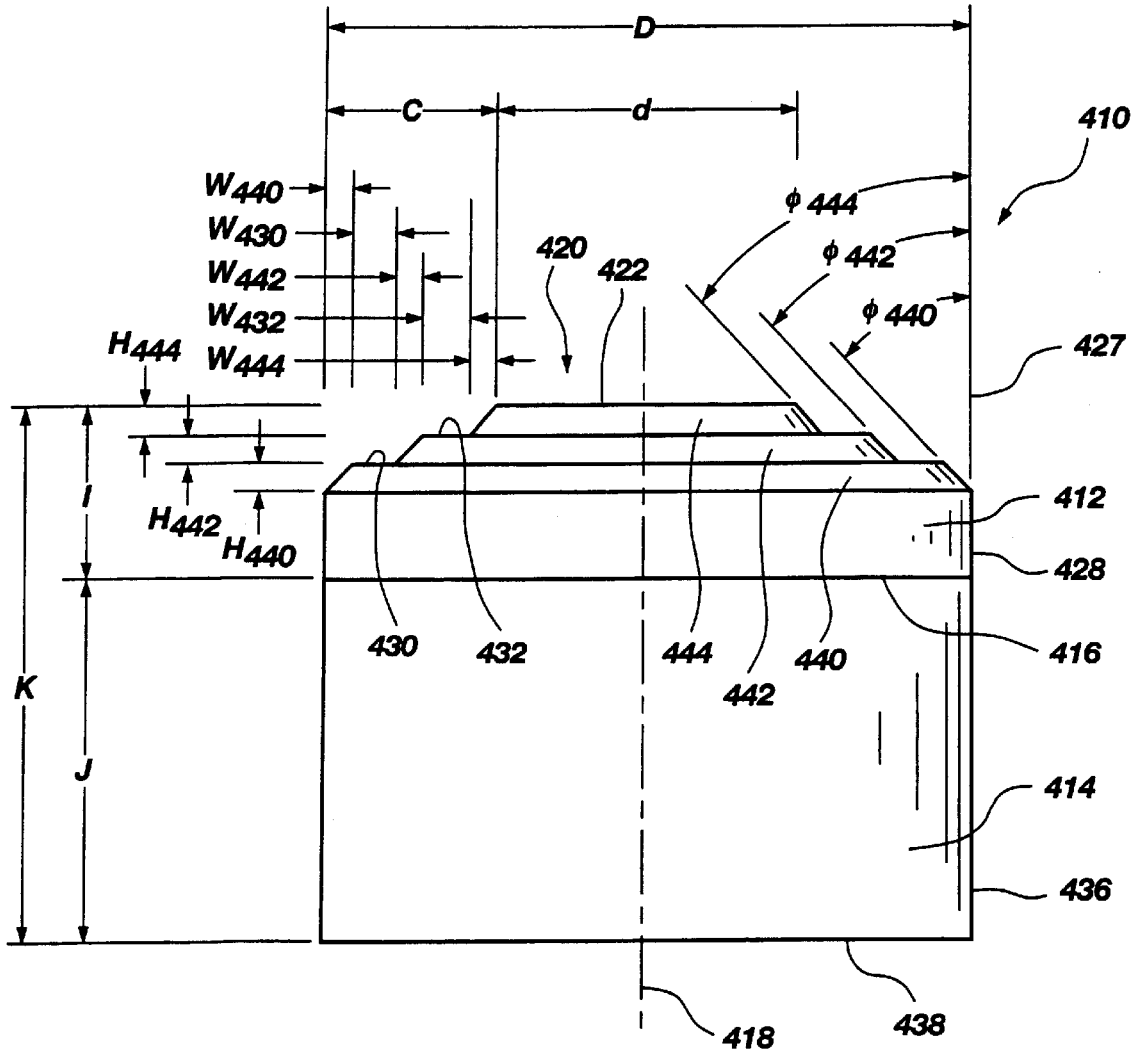
FIG. 16 is a side view of a cutting element provided with an alternative multi-aggressive cutting face particularly suitable for use in practicing the present invention.
Figure 17:
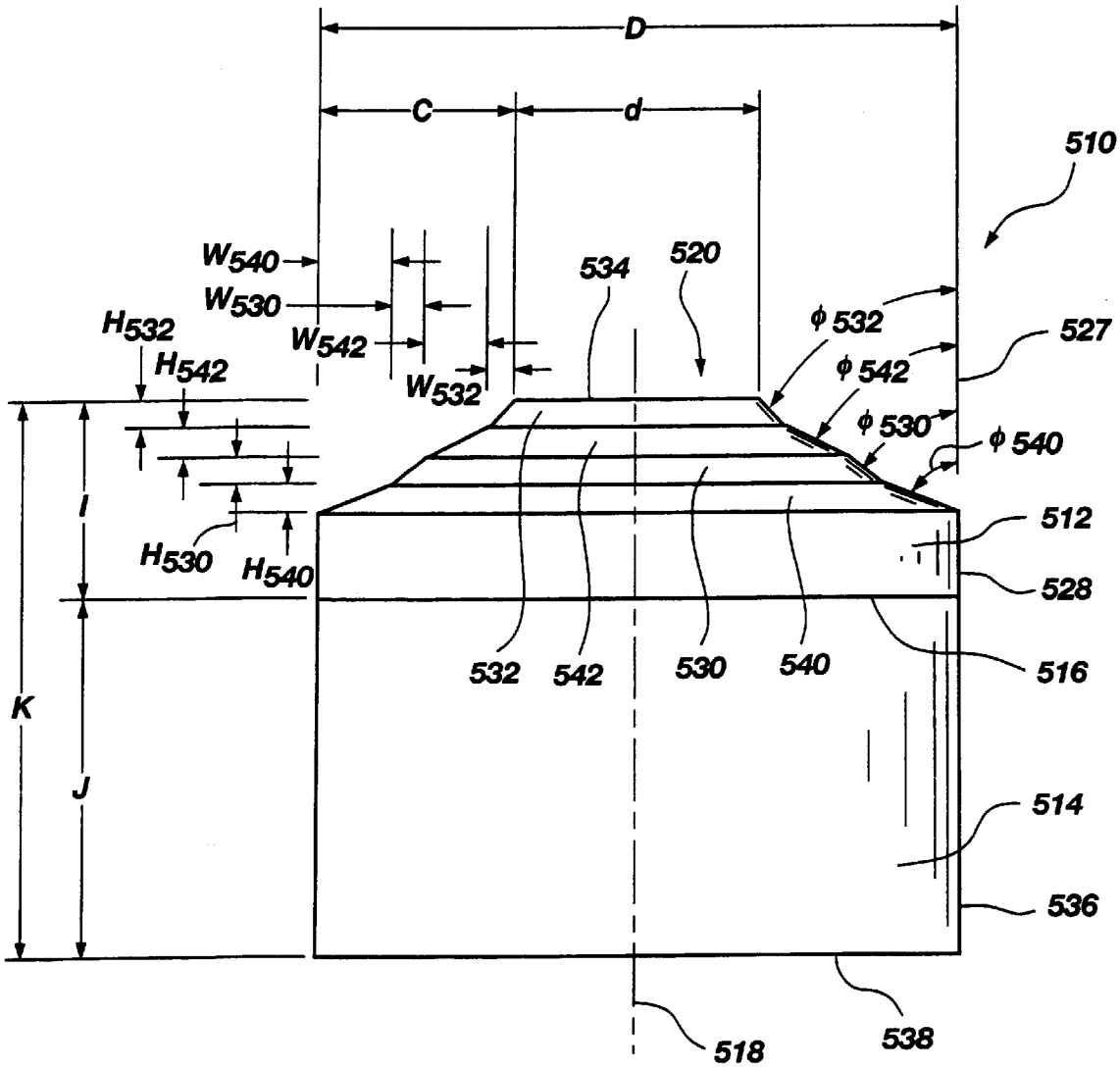
FIG. 17 is a side view of a cutting element embodying another alternative multi-aggressive cutting face particularly suitable for use in practicing the present invention.

FIGS. 16–17 illustrate cutting elements including exemplary, alternative multi-aggressive cutting faces which are particularly suitable for use with practicing the present method of drilling boreholes in subterranean formations. The variously illustrated cutters, while not only embodying the multi-aggressive feature of the present invention, additionally offer improved durability and cutting surface geometry as compared to prior known cutters suitable for installation upon subterranean rotary drill bits such as drag-type drill bits.

An additional alternative cutting element 410 is illustrated in FIG. 16. As with previously described and illustrated cutters herein, cutter 410 includes a PDC table 412, a substrate 414 having interface 416 therebetween, cutter 410 is provided with a multi-aggressive cutting face 420 preferably comprising a plurality of sloped cutting surfaces 440, 442, and 444 and a centermost, or radially innermost, cutting surface 422 which is generally perpendicular to the longitudinal axis 418. Substrate back surface 438 is also generally, but not necessarily, parallel with radially innermost cutting surface 422. Sloped cutting surfaces 440, 442, and 444 are sloped with respect to sidewalls 428 and 436, which are in turn, preferably parallel to longitudinal axis 418. Thus, cutter 410 is provided with a plurality of cutting surfaces which are progressively more aggressive the more radially inward each sloped cutting surface is positioned. Each of the respective cutting surfaces, or chamfer angles, $\phi_{440}$, $\phi_{442}$, and $\phi_{444}$ can be approximately the same angle as measured from an imaginary reference line 427 extending from sidewall 428 and parallel to the longitudinal axis 418. A cutting surface angle of approximately 45° as illustrated is well-suited for many applications. Optionally, each of the respective cutting surface angles $\phi_{440}$, $\phi_{442}$, and $\phi_{444}$ can be a progressively greater angle with respect to the periphery of the cutter in relation to the radial distance that each sloped surface is located away from longitudinal axis 418. For example, angle $\phi_{440}$ can be a more acute angle, such as approximately 25°, angle $\phi_{442}$ can be a slightly larger angle, such as approximately 45°, and angle $\phi_{444}$ can be a yet larger angle, such as approximately 65°.

Aggressive, generally non-sloping cutting surfaces, or shoulders 430 and 432 are respectively positioned radially and longitudinally intermediate of sloped cutting surfaces 440 and 442 and 442 and 444. As with radially innermost cutting surface 422, cutting surfaces 430 and 432 are generally perpendicular to longitudinal axis 418 and hence are also generally perpendicular to sidewalls 428 and the periphery of cutting element 410.

As with cutter 310 discussed and illustrated previously, each of the sloped cutting surfaces 440, 442, 444 of alternative cutter 410 is preferably angled with respect to the periphery of cutter 410, which is generally but not necessarily parallel to longitudinal axis 418, within respective ranges. That is, angles $\phi_{440}$, $\phi_{442}$ and $\phi_{444}$, taken as illustrated, are each approximately 45°. However, angles $\phi_{440}$, $\phi_{442}$, and $\phi_{444}$ may each be of a respectively different angle as compared to each other and need not be approximately equal. In general, it is preferred that each of the sloped cutting surfaces 440, 442, 444 be angled within a range extending from about 25° to about 65°; however, sloped cutting surfaces angled outside of this preferred range may be incorporated in cutters embodying the present invention.

Each respective sloped cutting surface 440, 442, 444 preferably exhibits a respective height $H_{440}$, $H_{442}$, and $H_{444}$, and width $W_{440}$, $W_{442}$, and $W_{444}$. Preferably non-sloped cutting surfaces, or shoulders, 430 and 432 preferably exhibit a width $W_{430}$ and $W_{432}$ respectively. The various dimensions C, d, D, I, J, and K are identical and consistent with the previously provided descriptions of the other cutting elements disclosed herein.

For example, the following respective dimensions would be exemplary of a cutter 410 having a diameter D of approximately 0.75 inches and a diameter d of approximately 0.350 inches. Cutting surfaces 430, 432, 440, 442, and 444 having the following respective heights and widths would be consistent with this particular embodiment with $H_{440}$ being approximately 0.0125 inches, $H_{442}$ being approximately 0.030 inches, $H_{444}$ being approximately 0.030 inches, $W_{440}$ being approximately 0.030 inches, $W_{442}$being approximately 0.030 inches, and $W_{444}$ being approximately 0.030 inches. It should be noted that dimensions other than these exemplary dimensions may be utilized in practicing the present invention. It should be kept in mind that when selecting the various widths, heights and angles to be exhibited by the various cutting surfaces to be provided on a cutter in accordance with the present invention, changing one characteristic such as width will likely affect one or more of the other characteristics such as the height and/or angle. Thus, when designing or selecting cutting elements to be used in practicing the present invention, it may be necessary to take into consideration how changing or modifying one characteristic of a given cutting surface will likely influence one or more other characteristics of a given cutter.

Figure 11:
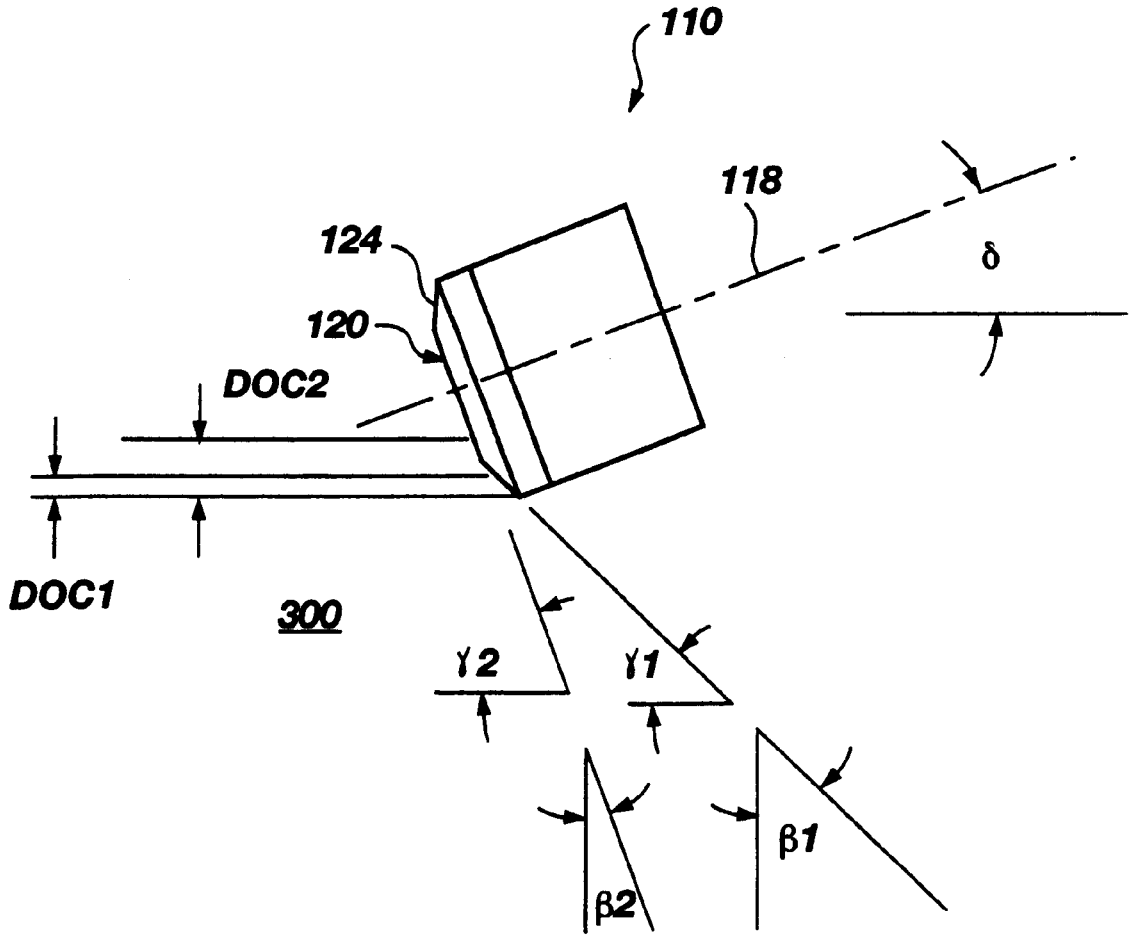
FIG. 11 comprises a side view of a PDC cutter as employed with one embodiment of the present invention, depicting the effects of chamfer backrake and cutter backrake.

Thus, it can now be appreciated that cutter 410, as illustrated in FIG. 16, includes a cutting face 420 which generally exhibits an overall aggressivity which progressively increases from a relatively low aggressiveness near the periphery of the cutter to a greatest-most aggressivity proximate the centermost or longitudinal axis of the exemplary cutter. Thus, centermost, or radially innermost, cutting surface 422 will be the most aggressive cutting surface upon cutting element 410 being installed at a preselected cutter backrake angle in a drill bit. Cutter 410, as illustrated in FIG. 16, is also provided with two relatively more aggressive cutting surfaces 430 and 432, each positioned radially and longitudinally so as to effectively provide cutting face 420 with a slightly more overall aggressive, multi-aggressive cutting face to engage a variety of formations regarded as being slightly harder than what could be defined as a normal range of formation hardnesses. Thus, one can now appreciate how, in accordance with the present invention, the cutting face of a cutter can be specifically customized, or tailored, to optimize the range of hardness and types of formations that may be drilled. The operation of drilling a borehole with a drill bit equipped with cutting elements 410 is essentially the same as the previously discussed cutting element 310. For instance, a cutting element 410 may engage a formation with cutting surfaces 430, 432, and 422 at respective depths of cut, analogous to the operation of cutters 110 and/or 310 as shown in FIGS. 11, 13, and 14.

A yet additional, alternative cutting element or cutter 510 is illustrated in FIG. 17. As with previously described and illustrated cutters herein, cutter 510 includes a PDC table 512, a substrate 514 and interface 516. Cutter 510 is provided with a multi-aggressive cutting face 520 preferably comprising a plurality of sloped cutting surfaces 540 and 542 and a centermost, or radially innermost cutting surface 534 which is generally perpendicular to the longitudinal axis 518. Back surface 538 of substrate 514 is also generally, but not necessarily, parallel to radially innermost cutting surface 534. Sloped cutting surfaces 540 and 542 are sloped so as to be substantially angled with respect to reference line 527 extending from sidewalls 528 and 536, which are, in turn, preferably parallel to longitudinal axis 518. Thus, cutter 510 is provided with a plurality of cutting surfaces which is of differing aggressiveness and which will preferably, but not necessarily, progressively more fully engage the formation being drilled in proportion to the softness thereof and/or the particular amount of weight-on-bit being applied upon bit 510. Each of the respective backrake angles $\phi_{540}$ and $\phi_{542}$ may be approximately the same angle, such as approximately 60° as illustrated. Optionally, cutting surface angle $\phi_{540}$ may be less than angle $\phi_{542}$ so as to provide a progressively greater aggressiveness with respect to the radial distance each substantially sloped surface is located away from longitudinal axis 518. For example, angle $\phi_{540}$ may be approximately 60°, while angle $\phi_{542}$ can be a larger angle, such as approximately 75°, with cutting surface 534 being oriented at yet a larger angle, such as approximately 90°, or perpendicular, to longitudinal axis 518 and sidewall 536.

Lesser sloped, or less substantially sloped, cutting surfaces 530 and 532 may be approximately the same angle, such as approximately 45° as shown in FIG. 17, or these exemplary lesser sloped cutting surfaces 530, 532 may be oriented at differing angles so that angles $\phi_{530}$ and $\phi_{532}$ are not approximately equal.

Because cutting surfaces 530 and 532 are less substantially sloped with respect to longitudinal axis 518/reference line 527, cutting surfaces 530 and 532 will be significantly less aggressive upon cutter 510 being installed in a bit, preferably at a selected cutter backrake angle usually as measured from the longitudinal axis of the cutter, but not necessarily. Generally less aggressive cutting surfaces 530 and 532 are respectively positioned radially and longitudinally intermediate of more aggressive cutting surfaces 540 and 542.

As with cutters 310 and 410 discussed and illustrated previously, each of the sloped cutting surfaces 540 and 542 of alternative cutter 510 is preferably angled with respect to the periphery of cutter 510, which is generally but not necessarily parallel to longitudinal axis 518, within respective preferred ranges. That is, cutting surface angle $\phi_{540}$ ranges from approximately 10° to approximately 80° with approximately 60° being well-suited for a wide variety of applications and cutting surface angle $\phi_{542}$ ranges from approximately 10° to approximately 80° with approximately 60° being well-suited for a wide variety of applications. Each respective sloped cutting surface preferably exhibits a respective height $H_{540}$, $H_{542}$, $H_{530}$, and $H_{532}$, and a respective width $W_{540}$, $W_{542}$, $W_{530}$, and $W_{532}$. The various dimensions C, d, D, I, J, and K are identical and consistent with the previously provided descriptions of the other cutting elements disclosed herein.

For example, the following respective dimensions would be exemplary of a cutter 510 having a diameter D of approximately 0.75 inches and a diameter d of approximately 0.500 inches. Cutting surfaces 530, 532, 540 and 542 having the following respective heights and widths would be consistent with this particular embodiment with $H_{530}$ being approximately 0.030 inches, $H_{532}$being approximately 0.030 inches, $H_{540}$being approximately 0.030 inches, $H_{542}$being approximately 0.030 inches, $W_{530}$being approximately 0.020 inches, $W_{532}$being approximately 0.060 inches, $W_{540}$being approximately 0.020 inches, and $W_{542}$being approximately 0.060 inches. Although, respective dimensions other than these exemplary dimensions may be utilized in accordance with the present invention. As described with respect to cutter 410 hereinabove, the above-described cutting surfaces of exemplary cutter 510 may be modified to exhibit dimensions and angles differing from the above exemplary dimensions and angles. Thus, changing one or more respective characteristics such as width, height, and/or angle that a given cutting surface is to exhibit will likely affect one or more of the other characteristics of a given cutting surface as well as the remainder of cutting surfaces provided on a given cutter.

Alternative cutter 510, as illustrated in FIG. 17, includes cutting face 520 which generally exhibits an overall multi-aggressivity cutting face profile which includes the relatively high aggressive cutting surface 540 near the periphery of cutter 510, the relatively less aggressive cutting surface 530 radially inward from cutting surface 540, the second relatively aggressive cutting surface 542 yet further radially inward from cutting surface 540, and the second relative less aggressive cutting surface 532 radially adjacent the centermost, most-aggressive cutting surface 534 generally centered about longitudinal axis 518. Thus, centermost, or radially innermost, cutting surface 534 will likely be the most aggressive cutting surface upon cutting element 510 being installed at a preselected cutter backrake angle in a subterranean drill bit.

Furthermore, alternative cutter 510, as illustrated in FIG. 17, is provided with at least two, longitudinally and radially positioned aggressive cutting surfaces 540 and 542 to provide cutting face 520 with a slightly less overall aggressive, multi-aggressive cutting face in comparison to cutter 410 to engage a variety of formations regarded as being slightly softer than what could be defined as a normal range of formation hardnesses. Thus, one can now appreciate how, in accordance with the present invention, the cutting face of a cutter can be specifically customized, or tailored, to optimize the range of hardness and types of formations that may drilled. The general operation of drilling a borehole with a drill bit equipped with cutting elements 510 is essentially the same as the previously discussed cutting elements 310 and 410; however, the cutting characteristics will be slightly different in that, as compared to cutting element 410 for example, cutting surfaces 540 and 542 will be slightly less aggressive than cutting surfaces 430 and 432 of cutting element 410 which were shown as being generally perpendicular to longitudinal axis 418. Therefore, when in operation, cutting element 510 would ideally be used for drilling relatively medium to soft formations with cutting surfaces 540 and 542 at respectively deeper depths-of-cut as these cutting surfaces, although more aggressive than cutting surfaces 430 and 432, are not very aggressive in an absolute sense due to the their respective angles $\phi_{540}$ and $\phi_{542}$ being of a more obtuse angle taken as shown in FIG. 17. Such angles effectively cause cutting surfaces 540 and 542 to less aggressively engage the formation being drilled. Even less aggressive cutting surfaces 530 and 532, which can be referred to as being nonaggressive in an absolute sense, are ideal for engaging soft to very soft formations due to their respective angles $\phi_{530}$ and $\phi_{532}$ being relatively acute taken as shown in FIG. 17.

Turning to FIG. 18 of the drawings, provided is an isolated view of a blade structure of an alternative drill bit 200' having the same, like numbered features as drill bit 200 shown in FIG. 9. In FIG. 18, however, blade structure, or blade, 206 is provided with a plurality of cutting elements 410 having multi-aggressive cutting faces 420 in a cone region of drill bit 200' and a plurality of cutting elements 310 having multi-aggressive cutting faces 320 on a radially outer portion of blade 206 which extends radially outward from the longitudinal axis of the drill bit toward the outer region of the bit. Thus, representative blade 206 of drill bit 200' has been customized, or tailored, to include cutters having cutting faces having one particular multi-aggressive cutting profile as well as to include other cutters having cutting faces of a differing multi-aggressive cutting profile. Moreover, it should readily be understood that drill bits can be provided with various combinations and positioning of cutting elements having conventionally configured cutting faces and a variety of multi-aggressive profiles to more efficiently and effectively drill boreholes through a variety of formations in accordance with the present invention as compared to the previously available technology and methods.

While superabrasive cutting elements embodying a variety of multi-aggressive cutting surfaces particularly suitable for use with practicing the present invention have been described and illustrated, those of ordinary skill in the art will understand and appreciate that the present invention is not so limited, and many additions, deletions, combinations, and modifications may be effected to the invention and the illustrated exemplary cutting elements without departing from the spirit and scope of the invention as claimed.

What is claimed is:

1. A method of drilling subterranean formations comprising:

providing a rotary drill bit including at least one cutting element thereon, the at least one cutting element including a longitudinal axis, a radially outermost sidewall, a superabrasive, multi-aggressive cutting face extending in two dimensions generally transverse to the longitudinal axis, the cutting face of the at least one cutting element including a first cutting surface oriented at a first angle with respect to a reference line adjacent the radially outermost sidewall and extending parallel to the longitudinal axis of the at least one cutting element, a second cutting surface adjacent the first cutting surface oriented at a second angle less than the first angle with respect to the reference line extending parallel to the longitudinal axis, and an additional, circumferentially extending chamfered surface positioned radially and axially intermediate the first cutting surface and the sidewall radially outermost of the superabrasive, multi-aggressive cutting face, the additional, circumferentially extending chamfered surface oriented at an angle less than the second angle of the second cutting surface of the superabrasive, multi-aggressive cutting face;

drilling a relatively hard formation with the rotary drill bit by engaging primarily at least a portion of the first cutting surface of the superabrasive, multi-aggressive cutting face of the at least one cutting element with the relatively hard formation at a first depth-of-cut; and drilling a relatively soft formation with the rotary drill bit by engaging at least a portion of the second cutting surface of the superabrasive, multi-aggressive cutting face of the at least one cutting element with the relatively soft formation in addition to engaging at least a portion of the relatively soft formation with at least a portion of the first cutting surface of the superabrasive, multi-aggressive cutting face at a second depth-of-cut.

2. The method of claim 1, wherein drilling the relatively soft formation and drilling the relatively hard formation comprise drilling the relatively soft formation and the relatively hard formation at a generally constant weight-on-bit.

3. A method of drilling subterranean formations comprising:

providing a rotary drill bit including at least one cutting element thereon, the at least one cutting element including a longitudinal axis, a radially outermost sidewall, a superabrasive, multi-aggressive cutting face extending in two dimensions generally transverse to the longitudinal axis, the cutting face of the at least one cutting element including a first cutting surface oriented at a first angle with respect to a reference line adjacent the radially outermost sidewall and extending parallel to the longitudinal axis of the at least one cutting element, a second cutting surface adjacent the first cutting surface oriented at a second angle less than the first angle with respect to the reference line extending parallel to the longitudinal axis, and a third, radially innermost cutting surface;

drilling a relatively hard formation with the rotary drill bit by engaging primarily at least a portion of the first cutting surface of the superabrasive, multi-aggressive cutting face of the at least one cutting element with the relatively hard formation at a first depth-of-cut; and drilling a relatively soft formation with the rotary drill bit by engaging at least a portion of the second cutting surface of the superabrasive, multi-aggressive cutting face of the at least one cutting element with the relatively soft formation in addition to engaging at least a portion of the relatively soft formation with at least a portion of the first cutting surface of the superabrasive, multi-aggressive cutting ace at a second depth-of-cut.

4. The method of claim 3, wherein providing the rotary drill bit including at least one cutting element thereon comprises providing the superabrasive, multi-aggressive cutting face of the at least one cutting element with a third, radially innermost cutting surface oriented approximately perpendicular to the longitudinal axis of the at least one cutting element.

5. The method of claim 3, wherein drilling the relatively soft formation and drilling the relatively hard formation comprise drilling the relatively soft formation and the relatively hard formation at a generally constant weight-on-bit.

6. A method of drilling subterranean formations comprising:

providing a rotary drill bit including a plurality of circumferentially spaced, longitudinally extending blade structures having a plurality of cutting elements on each of the plurality of blade structures, at least one cutting element of the plurality of cutting elements including a longitudinal axis, a superabrasive, multi-aggressive cutting face extending in two dimensions generally transverse to the longitudinal axis, a radially outermost sidewall of the cutting face, the cutting face of the at least one cutting element including a first cutting surface oriented at a first angle with respect to a reference line adjacent the radially outermost sidewall and extending parallel to the longitudinal axis of the at least one cutting element, and a second cutting surface adjacent the first cutting surface oriented at a second angle less than the first angle with respect to the reference line extending parallel to the longitudinal axis;

drilling a relatively hard formation with the rotary drill bit by engaging primarily at least a portion of the first cutting surface of the superabrasive, multi-aggressive cutting face of the at least one cutting element with the relatively hard formation at a first depth-of-cut; and drilling a relatively soft formation with the rotary drill bit by engaging at least a portion of the second cutting surface of the superabrasive, multi-aggressive cutting face of the at least one cutting element with the relatively soft formation in addition to engaging at least a portion of the relatively soft formation with at least a portion of the first cutting surface of the superabrasive, multi-aggressive cutting face at a second depth-of-cut at a respectively selected weight-on-bit which maximizes a rate-of-penetration through each formation and which generates a respective torque-on-bit which is below a selected threshold.

7. The method of claim 6, wherein providing the rotary drill bit including a plurality of circumferentially spaced, longitudinally extending blade structures comprises providing a plurality of circumferentially spaced, longitudinally extending blade structures having a plurality of the at least one cutting elements oriented at preselected cutting element backrake angles.

8. The method of claim 6, wherein drilling the relatively soft formation and drilling the relatively hard formation comprise drilling the relatively soft formation and the relatively hard formation at a generally constant weight-on-bit.

9. A method of drilling subterranean formations comprising:

providing a rotary drill bit including at least one cutting element thereon, the at least one cutting element including a longitudinal axis, a superabrasive, multi-aggressive cutting face extending in two dimensions generally transverse to the longitudinal axis, a radially outermost sidewall of the cutting face; the cutting face of the at least one cutting element including a first cutting surface oriented at a first angle with respect to a reference line adjacent the radially outermost sidewall and extending parallel to the longitudinal axis of the at least one cutting element, a second cutting surface adjacent the first cutting surface oriented at a second angle less than the first angle with respect to the reference line extending parallel to the longitudinal axis, of approximately 45°, and at least one additional, circumferentially extending chamfered surface sloped at an angle of approximately 45° with respect to the reference line extending parallel to the longitudinal axis and positioned radially and axially intermediate the first cutting surface and the radially outermost sidewall of the superabrasive, multi-aggressive cutting face;

drilling a relatively hard formation with the rotary drill bit by engaging primarily at least a portion of the first cutting surface of the superabrasive, multi-aggressive cutting face of the at least one cutting element with the relatively hard formation at a first depth-of-cut; and drilling a relatively soft formation with the rotary drill bit by engaging at least a portion of the second cutting surface of the superabrasive, multi-aggressive cutting face of the at least one cutting element with the relatively soft formation in addition to engaging at least a portion of the relatively soft formation with at least a portion of the first cutting surface of the superabrasive, multi-aggressive cutting face at a second depth-of-cut.

10. The method of claim 9, wherein providing the rotary drill bit including at least one cutting element thereon comprises providing the superabrasive, multi-aggressive cutting face with a first cutting surface having a width within a range of approximately 0.025 of an inch to approximately 0.075 of an inch and comprises providing a second cutting surface having a width within a range of approximately 0.025 of an inch to approximately 0.075 of an inch.

11. A method of drilling subterranean formations comprising:

providing a rotary drill bit including at least one cutting element thereon, the at least one cutting element including a longitudinal axis, a radially outermost sidewall, a superabrasive, multi-aggressive cutting face extending in two dimensions generally transverse to the longitudinal axis, the cutting face of the at least one cutting element including a first cutting surface oriented at a first angle with respect to a reference line adjacent the radially outermost sidewall and extending parallel to the longitudinal axis of the at least one cutting element, a second cutting surface adjacent the first cutting surface oriented at a second angle less than the first angle with respect to the reference line extending parallel to the longitudinal axis, and a third radially innermost cutting surface;

drilling a relatively hard formation with the rotary drill bit by engaging primarily at least a portion of the first cutting surface of the superabrasive, multi-aggressive cutting face of the at least one cutting element with the relatively hard formation at a first depth-of-cut;

drilling a relatively soft formation with the rotary drill bit by engaging at least a portion of the second cutting surface of the superabrasive, multi-aggressive cutting face of the at least one cutting element with the relatively soft formation in addition to engaging at least a portion of the relatively soft formation with at least a portion of the first cutting surface of the superabrasive, multi-aggressive cutting face at a second depth-of-cut; and drilling a relatively very soft formation by additionally engaging at least a portion of the third cutting surface of the superabrasive, multi-aggressive cutting face to a third depth-of-cut which is substantially greater than the second depth-of-cut.

12. The method of claim 11, wherein providing a third cutting surface comprises providing a third cutting surface having a diameter within a range of approximately 0.1 of an inch to approximately 0.5 of an inch.

13. The method of claim 12, wherein drilling the relatively soft formation and drilling the relatively hard formation comprise drilling the relatively soft formation and the relatively hard formation at a generally constant weight-on-bit.

14. The method of claim 11, wherein drilling the relatively soft formation and drilling the relatively hard formation comprise drilling the relatively soft formation and the relatively hard formation at a generally constant weight-on-bit.

15. The method of claim 11, Wherein drilling the relatively hard formation, the relatively soft formation, and the relatively very soft formation comprises drilling at a respectively selected weight-on-bit which maximizes a rate-of-penetration and which generates a torque-on-bit which is below a selected threshold.

16. A method of drilling subterranean formations of varying hardness with a rotary drill bit including a plurality of cutting elements having a multi-aggressive cutting profile and disposed at preselected cutting element backrake angles thereon comprising:

providing the rotary drill bit with a plurality of superabrasive cutting elements having a multi-aggressive cutting profile and installed thereon at preselected cutting element backrake angles which will provide an optimum rate-of-penetration for expected hardnesses of the subterranean formations in which the borehole is to be drilled, each of the plurality of superabrasive cutting elements comprising a plurality of cutting surfaces preselectively angled with respect to a reference line positioned adjacent an outer periphery of each of the plurality of cutting elements and extending parallel to a longitudinal axis of each of the plurality of cutting elements, and each of the plurality of cutting surfaces respectively positioned at a preselected radial distance from the longitudinal axis of each of the plurality of superabrasive cutting elements;

drilling a borehole with the rotary drill bit at a preselected weight-on-bit;

generally maintaining the preselected weight-on-bit within a preselected tolerance;

drilling a relatively hard formation by engaging at least one cutting surface of the plurality positioned more radially outward with respect to the longitudinal axis with the relatively hard formation at a first depth-of-cut;

drilling a relatively less hard formation by additionally engaging at least one other cutting surface of the plurality positioned more radially inward with respect to the longitudinal axis with the relatively less hard formation at a second depth-of-cut greater than the first depth-of-cut; and wherein drilling the relatively hard formation and drilling the relatively less hard formation at the preselected weight-on-bit generates a torque-on-bit value which is less than a threshold value which would cause the rotary drag bit to stall.

17. The method of claim 16, wherein at least one of the drilling a relatively hard formation and the drilling a relatively less hard formation comprises directional control of the drilling.

18. A method of drilling subterranean formations of varying hardness with a rotary drill bit including a plurality of cutting elements having a multi-aggressive cutting profile and disposed at preselected cutting element backrake angles thereon comprising:

providing the rotary drill bit with a plurality of circumferentially spaced, longitudinally extending blade structures, a plurality of superabrasive cutting elements having a multi-aggressive cutting profile, each of the plurality of superabrasive cutting elements comprising a plurality of cutting surfaces preselectively angled with respect to a reference line positioned adjacent an outer periphery of each of the plurality of cutting elements and extending parallel to a longitudinal axis of each of the plurality of cutting elements, and each of the plurality of cutting surfaces respectively positioned at a preselected radial distance from the longitudinal axis of each of the plurality of superabrasive cutting elements;

wherein at least some of the blade structures carry at least some of the superabrasive cutting elements having multi-aggressive cutting profiles thereon and at least one longitudinally extending blade structure of the plurality of blade structures carries superabrasive cutting elements having multi-aggressive cutting profiles which differ from each other on at least one of the blade structures of the plurality of blade structures;

wherein at least one blade structure carries at least one superabrasive cutting element having a generally more aggressive multi-aggressive cutting profile as compared to the multi-aggressive cutting profile of at least one other superabrasive cutting element carried on the same blade structure;

drilling a borehole with the rotary drill bit at a preselected weight-on-bit;

generally maintaining the preselected weight-on-bit within a preselected tolerance;

drilling a relatively hard formation by engaging at least one cutting surface of the plurality positioned more radially outward with respect to the longitudinal axis with the relatively hard formation at a first depth-of-cut; and drilling a relatively less hard formation by additionally engaging at least one other cutting surface of the plurality positioned more radially inward with respect to the longitudinal axis with the relatively less hard formation at a second depth-of-cut greater than the first depth-of-cut.

19. The method of claim 18, wherein providing the rotary drill bit with the plurality of circumferentially spaced, longitudinally extending blade structures carrying at least one superabrasive cutting element having the generally more aggressive multi-aggressive cutting profile as compared to the multi-aggressive cutting profile of the at least one other cutting element carried on the same blade structure comprises providing a rotary drill with a plurality of circumferentially spaced, longitudinally extending blade structures carrying in a first region of each blade structure a plurality of cutting elements having a generally more aggressive multi-aggressive cutting profile as compared to a multi-aggressive cutting profile of a plurality of cutting elements carried in a second region of each blade structure.

20. The method of claim 18, wherein at least one of the drilling a relatively hard formation and the drilling a relatively less hard formation comprises directional control of the drilling.

21. A method of drilling subterranean formations comprising:

providing a rotary drill bit including at least one cutting element thereon, the at least one cutting element including a longitudinal axis, a radially outermost sidewall, and a superabrasive, multi-aggressive cutting face extending in two dimensions generally transverse to the longitudinal axis, the cutting face of the at least one cutting element including a first cutting surface oriented at a first angle with respect to a reference line positioned adjacent the radially outermost sidewall and extending parallel to the longitudinal axis, a second cutting surface positioned radially inward of the first cutting surface and oriented at a second angle with respect to the reference line extending parallel to the longitudinal axis, a third cutting surface positioned radially inward of the second cutting surface and oriented at a third angle with respect to the reference line extending parallel to the longitudinal axis, and a fourth cutting surface positioned radially inward of the third cutting surface and oriented at a fourth angle with respect to the reference line extending parallel to the longitudinal axis;

drilling a relatively hard formation with the rotary drill bit by engaging at least a portion of the first cutting surface of the cutting face of the at least one cutting element with the relatively hard formation at a first depth-of-cut; and drilling a relatively soft formation with the rotary drill bit by engaging at least a portion of at least one of the second cutting surface, the third cutting surface, and the fourth cutting surface of the superabrasive, multi-aggressive cutting face of the at lest one cutting element with the relative soft formation at a second depth-of-cut in addition to engaging at least a portion of the relative soft formation with at least a portion of the first cutting surface of the superabrasive, multi-aggressive cutting face.

22. The method of claim 21, wherein providing the rotary drill bit including at least one cutting element comprises providing the superabrasive, multi-aggressive cutting face with an additional, circumferentially extending chamfered surface positioned radially and axially intermediate the first cutting surface and a sidewall surface of the superabrasive, multi-aggressive cutting face.

23. The method of claim 21, wherein providing the rotary drill bit including at least one cutting element thereon comprises providing the superabrasive, multi-aggressive cutting face of the at least one cutting element with a radially innermost cutting surface.

24. The method of claim 21, wherein providing the rotary drill bit including at least one cutting element thereon comprises providing the superabrasive, multi-aggressive cutting face of the at least one cutting element with a radially innermost cutting surface oriented approximately perpendicular to the longitudinal axis of the at least one cutting element.

25. The method of claim 21, wherein providing the rotary drill bit including at least one cutting element thereon comprises providing a rotary drill bit including a plurality of circumferentially spaced, longitudinally extending blade structures with at least one of the plurality of blade structures carrying the at least one cutting element.

26. The method of claim 25, wherein providing the rotary drill bit including the plurality of circumferentially spaced, longitudinally extending blade structures comprises providing a rotary drill bit comprising a plurality of cutting elements on each of the plurality of blade structures.

27. The method of claim 26, wherein providing the rotary drill bit including a plurality of circumferentially spaced, longitudinally extending blade structures comprises providing a plurality of circumferentially spaced, longitudinally extending blade structures having a plurality of the at least one cutting element at a preselected cutting element back-rake angle.

28. The method of claim 26, wherein drilling the relatively hard formation and the relatively soft formation comprises drilling the relatively hard formation and the relatively soft formation at a respectively selected weight-on-bit which maximizes the rate-of-penetration through each formation and which generates a respective torque-on-bit which is below a selected threshold.

29. The method of claim 21, wherein providing the rotary drill bit including at least one cutting element thereon comprises providing the superabrasive, multi-aggressive cutting face with the second cutting surface oriented at the second angle with respect to the reference line parallel to the longitudinal axis of the at least one cutting element and orienting the second cutting surface at a second angle ranging between approximately 30° and approximately 60°.

30. The method of claim 29, wherein providing the rotary drill bit including at least one cutting element thereon comprises providing the superabrasive, multi-aggressive cutting face with the fourth cutting surface oriented at the fourth angle with respect to the reference line parallel of the longitudinal axis of the at least one cutting element and orienting the fourth cutting surface at a fourth angle approximately equal to the second angle.

31. The method of claim 30, wherein providing the superabrasive, multi-aggressive cutting face with the second cutting surface oriented at the second angle and the fourth cutting surface oriented at the fourth angle approximately equal to the second angle comprises orienting the second and fourth cutting surfaces at an angle of approximately 45°.

32. The method of claim 21, wherein providing the rotary drill bit including at least one cutting element thereon comprises providing the superabrasive, multi-aggressive cutting face with the first cutting surface oriented at the first angle with respect to the reference line extending parallel to the longitudinal axis of the at least one cutting element not exceeding approximately 30°.

33. The method of claim 21, wherein providing the rotary drill bit including at least one cutting element thereon comprises providing the superabrasive, multi-aggressive cutting face with the third cutting surface oriented at the third angle with respect to the reference line extending parallel to the longitudinal axis of the at least one cutting element approximately equal to the first angle.

34. The method of claim 33, wherein providing the superabrasive, multi-aggressive cutting face with the first cutting surface oriented at the first angle and the third cutting surface oriented at the third angle approximately equal to the first angle comprises orienting the first and third cutting surfaces at an angle ranging between approximately 60° and approximately 70°.

35. The method of claim 21, wherein providing the rotary drill bit including at least one cutting element thereon comprises providing the superabrasive, multi-aggressive cutting face with the first cutting surface oriented at the first angle with respect to the reference line parallel to the longitudinal axis of the at least one cutting element and orienting the first cutting surface at the first angle ranging between approximately 30° and approximately 60°.

36. The method of claim 35, wherein providing the rotary drill bit including at least one cutting element thereon comprises orienting the fourth cutting surface at the fourth angle approximately equal to the second angle.

37. The method of claim 21, wherein providing the rotary drill bit including at least one cutting element thereon further comprises providing a fifth cutting surface positioned radially inward of the fourth cutting surface, the fifth cutting surface being oriented at a fifth angle with respect to the reference line extending parallel to the longitudinal axis.

38. The method of claim 37, wherein providing the fifth cutting surface positioned radially inward of the fourth cutting surface comprises orienting the fifth cutting surface at the fifth angle approximately equal to the first angle.

39. The method of claim 38, wherein orienting the fifth cutting surface at the fifth angle approximately equal to the first angle comprises orienting the third cutting surface at the third angle approximately equal to the first and fifth angles.

40. The method of claim 39, wherein orienting the fifth cutting surface at the fifth angle approximately equal to the first angle and orienting the third cutting surface at the third angle approximately equal to the first and fifth angles comprises the first, third, and fifth cutting surfaces being angled within a range of approximately 30° to approximately 60°.

41. The method of claim 40, wherein providing the superabrasive, multi-aggressive cutting face with the first cutting surface, the third cutting surface, and the fifth cutting surface being angled within a range of approximately 30° to approximately 60° comprises orienting the first, third, and fifth cutting surfaces at an angle of approximately 45°.

42. The method of claim 38, wherein providing the rotary drill bit including at least one cutting element thereon comprises providing the superabrasive, multi-aggressive cutting face with the fourth cutting surface oriented at the fourth angle with respect to the reference line extending parallel to the longitudinal axis of the at least one cutting element approximately equal to the second angle.

43. The method of claim 21, wherein providing the rotary drill bit including at least one cutting element thereon comprises providing the superabrasive, multi-aggressive cutting face with the second cutting surface oriented at the second angle with respect to the reference line extending parallel to the longitudinal axis of the at least one cutting element of approximately 90°so as to orient the second cutting surface generally perpendicular to the longitudinal axis.

* * * * *